US009004490B2

(12) United States Patent
Kazakov et al.

(10) Patent No.: US 9,004,490 B2
(45) Date of Patent: Apr. 14, 2015

(54) PROJECTILE TARGET SYSTEM

(71) Applicant: Hex Systems Pty. Ltd., Beecroft NSW (AU)

(72) Inventors: Dmitri Kazakov, Beecroft (AU); Vadim Gerasimov, Hornsby (AU)

(73) Assignee: Hex Systems Pty. Ltd., Beecroft NSW (AU)

( * ) Notice: Subject to any disclaimer, the term of this patent is extended or adjusted under 35 U.S.C. 154(b) by 95 days.

(21) Appl. No.: 13/675,506

(22) Filed: Nov. 13, 2012

(65) Prior Publication Data

US 2013/0193645 A1 Aug. 1, 2013

(30) Foreign Application Priority Data

Nov. 13, 2011 (AU) ..... 2011250746

(51) Int. Cl.
*F41J 5/06* (2006.01)
*F41J 5/14* (2006.01)
*F41J 5/056* (2006.01)

(52) U.S. Cl.
CPC .... *F41J 5/06* (2013.01); *F41J 5/14* (2013.01); *F41J 5/056* (2013.01)

(58) Field of Classification Search
USPC ..... 273/371–377, 403, 404, 407, 408
See application file for complete search history.

(56) References Cited

U.S. PATENT DOCUMENTS

| | | | | | |
|---|---|---|---|---|---|
| 3,778,059 | A * | 12/1973 | Rohrbaugh et al. | ..... | 273/372 |
| 4,349,728 | A * | 9/1982 | Phillips et al. | ..... | 235/400 |
| 4,630,832 | A * | 12/1986 | Swanson | ..... | 273/374 |
| 5,095,433 | A * | 3/1992 | Botarelli et al. | ..... | 273/372 |
| 5,447,315 | A * | 9/1995 | Perkins | ..... | 273/371 |
| 5,642,109 | A * | 6/1997 | Crowley et al. | ..... | 341/22 |
| 6,367,800 | B1 * | 4/2002 | Sheck et al. | ..... | 273/372 |
| 6,669,477 | B2 * | 12/2003 | Hulet | ..... | 434/14 |
| 8,437,697 | B2 * | 5/2013 | Dakshinamurthy et al. | .... | 455/45 |
| 2006/0006597 | A1 * | 1/2006 | Maeda et al. | ..... | 273/374 |
| 2012/0043722 | A1 * | 2/2012 | Mironichev et al. | ..... | 273/406 |
| 2013/0093138 | A1 * | 4/2013 | Fraser et al. | ..... | 273/350 |
| 2013/0147117 | A1 * | 6/2013 | Graham et al. | ..... | 273/393 |

FOREIGN PATENT DOCUMENTS

DE 7726275 * 3/1978

* cited by examiner

*Primary Examiner* — Mark Graham
(74) *Attorney, Agent, or Firm* — Robert J. Sacco, Esq.; Fox Rothschild LLP

(57) ABSTRACT

According to one aspect of the present invention, a projectile target is disclosed comprising a target having a substantially sealed chamber having a front face and a rear face with an enclosing side wall disposed intermediate. The front and rear faces are formed by membranes configured to allow a projectile to pass therethrough and then substantially seal to maintain the substantially sealed chamber. Pressure wave sensors are disposed within the chamber and are configured to detect pressure waves created by the projectile. A target controller receives signals from the pressure sensors indicative of the pressure sensed by the sensors and determines an impact point of the projectile on the front face of the target.

7 Claims, 19 Drawing Sheets

PROJECTILE TARGET SYSTEM

CROSS REFERENCE TO RELATED APPLICATIONS

This application claims priority from Australian Patent Application Serial No. 2011250746, filed on 13 Nov. 2011.

BACKGROUND OF THE INVENTION

The present invention relates to projectile targets and, in particular, to an electronic projectile target.

The invention has been developed primarily for use as firearm projectile range targets and will be described hereinafter with reference to this application. However, it will be appreciated that the invention is not limited to this particular field of use and is applicable to other projectiles, for example, arrows.

It is now becoming known to use electronic targets in shooting ranges. The use of electronic target allows a shooter to fire projectiles at target and not have to physically retrieve the target or observe this through the use of binoculars or a rangefinder in order to determine the location a projectile hits the target.

It is crucially important in competitive shooting tournaments to measure the position a projectile hits the target with as great an accuracy as possible. Whilst observing the targets at close range achieves this purpose, it will be appreciated that someone must necessarily do this. The use of electronic targets therefore removes the need for people to determine the position projectiles hit the target and also to retrieve the target in such cases.

Various electronic target devices have been developed, and it will be appreciated that a distinct problem of providing a projectile target is that the target gets shot, thereby damaging it. An array of sensors disposed over the face of the target would each be damaged or destroyed by a projectile passing through it and so a simple two-dimensional detector on or over the target face is of little practical value.

It is also known to address this problem by using up to four sound sensors to sense the sound waves generated by the impact of the projectile on the front face of the target or by measuring radially propagating ultra-sonic waves generated by the projectile travelling through the target. These prior art targets are sufficient for providing a rough estimation of the location the projectile hits the face of the target, however, they are not reliable. For example, the prior art targets are prone to designate a miss when not the case or a position that is significantly different from actual to change score.

In addition to the prior art targets and systems lacking in accuracy of shot detection, many other problems are known to plague the prior art. For example, connecting and replacing targets is cumbersome and there are significant costs in acquiring and installing associated componentry such as cabling and patchboards. The known electronic target systems are incapable of accurately and dynamically correcting for sensor error. These errors simply propagate. Further, those systems do not always capture the sound wave by the projectile but may be interfered with.

The genesis of the invention is a desire to provide a projectile target that will overcome or substantially ameliorate one or more of the disadvantages of the prior art, or to provide a useful alternative.

SUMMARY OF THE INVENTION

According to a first aspect of the invention there is provided a projectile target comprising:

a substantially sealed chamber having a front face and a spaced apart rear face with an enclosing side wall disposed intermediate, said front and rear faces being formed by membranes configured to allow a projectile to pass therethrough and to substantially seal to maintain said substantially seal chamber;

at least four spaced apart pressure wave sensors disposed within said chamber, said sensors configured to detect pressure waves created by said projectile;

a target controller in communication with said sensors and configured to receive signals therefrom indicative of the pressure sensed by said sensors wherein the time difference between receipt by said controller of signals from said sensors and discriminating with respect to sensor position to determine an impact point on said front face of said target such that said controller provides an output indicative of said impact point.

According to a third aspect of the invention there is provided a method of providing a shooter projectile target collision reduction system, the method comprising the steps of:

providing a sound chamber based projectile target;

applying a predetermined collision protection time according to known shooting distances for the multiple shooters based upon a time to impact difference for projectiles having different velocities;

measuring the projectile speed at muzzle point of each shooter and calculating the impact time; and measure time of flight between firing and impact and in the event there are no collisions between different shooters projectiles detected said measured time of flight is used for collision margin calculation.

According to a fourth aspect of the invention there is provided a projectile target comprising:

a substantially sealed chamber having a front face and a spaced apart rear face with an enclosing side wall disposed intermediate, said front and rear faces being formed by membranes configured to allow a projectile to pass therethrough and to substantially seal to maintain said substantially seal chamber;

a plurality of spaced apart pressure wave sensors disposed within said chamber, said sensors configured to detect pressure waves created by said projectile travelling within the chamber;

a target controller in communication with said sensors and configured to receive signals therefrom indicative of the pressure sensed by said sensors wherein the time difference between receipt by said controller of signals from said sensors and discriminating with respect to sensor position to determine an impact point on said front face of said target such that said controller provides an output indicative of said impact point; and wherein said target controller is mounted to said target and movable between an in use position wherein the controller is moved clear of said target and a stowed position wherein the controller is adjacent to, contiguous with or disposed within said target.

According to a fifth aspect of the invention there is provided a system for detecting the muzzle blast of a firearm including an accelerometer mounted to said firearm or the shoulder, arm or wrist of a shooter.

According to another aspect of the invention there is provided a method of correcting or calibrating each sensor in a target having 4 or more pressure wave sensors, the method comprising the steps of:

determining all possible sensor impact positions for all combinations of 3-sensors out of all the sensors that have been triggered by a projectile pressure wave the wave;

averaging all the values of all combinations of 3-sensors and determining an approximated point of impact;

using redundant information provided by all combinations of 3-sensors to correct each sensor error and to increase further accuracy by applying a statistical calculation in real-time for every shot.

It can therefore be seen that there is advantageously provided a target that can use five or more pressure sensors to more accurately determine the location of impact of a projectile on the target. Further, additional sensors can be used as desired without significantly increasing the computational load on the target controller. The use of the five or more sensors not only provides more accurate determination of projectile position but also allows the provision of redundant information to ignore spurious or inaccurate data and increase reliability.

Yet further, the simple wireless set up between target, wireless link and range computer, client devices or internet allows the determined information to be easily and quickly sent to the shooters, scorers or a third party directly or via a telephonic network or the internet. This allows competitions to be held simultaneously with competitors at different ranges. The use of sequentially cable connected targets is also removed improving reliability for example with respect to faults in the cabling or connection, and to remove any tripping hazards. Importantly, installation of the system is significantly simplified over known systems as no cabling is required to be laid between or from targets. It will also be appreciated that in preferred embodiments there is provided a projectile target collision reduction system which also allows for multiple shooter projectile targets.

BRIEF DESCRIPTION OF THE DRAWINGS

A preferred embodiment of the invention will now be described, by way of example only, with reference to the accompanying drawings in which.

DETAILED DESCRIPTION OF THE PREFERRED EMBODIMENTS

Figure 1:
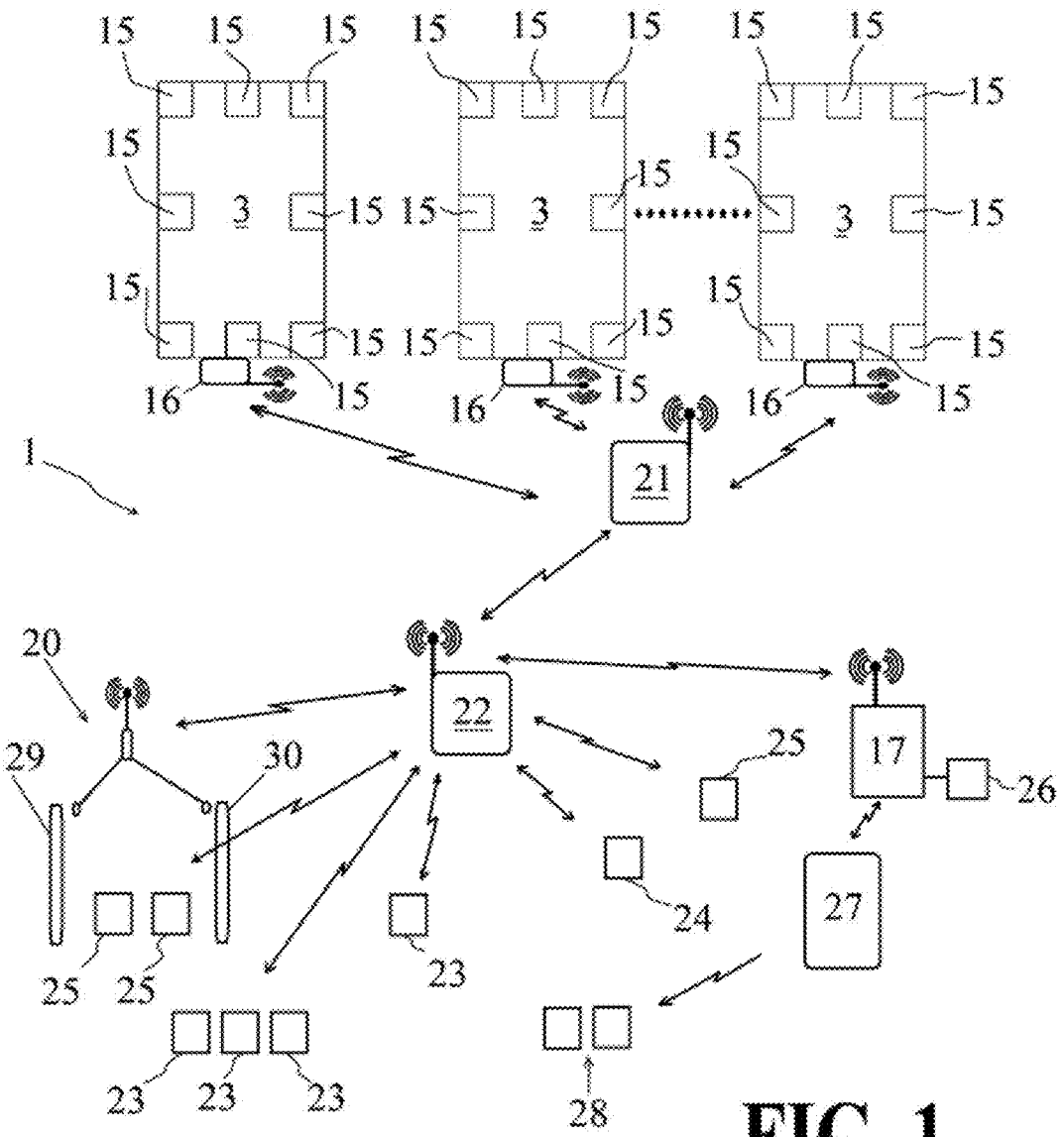
FIG. 1 is a schematic overview of a range shooting system according to the preferred embodiment.

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing the preferred exemplary embodiments of the invention. It being understood that various changes may be made in the function and arrangement of elements without departing from the spirit and scope of the invention, as set forth in the appended claims.

To aid in describing the invention, directional terms are used in the specification and claims to describe portions of the present invention (e.g., upper, lower, left, right, etc.). These directional definitions are merely intended to assist in describing and claiming the invention and are not intended to limit the invention in any way. In addition, reference numerals that are introduced in the specification in association with a drawing figure may be repeated in one or more subsequent figures without additional description in the specification in order to provide context for other features.

It will be appreciated that throughout the description of the preferred embodiments like reference numerals have been used to denote like components unless expressly stated otherwise.

Referring to FIG. 1, there is shown the range shooting system 1 according to the preferred embodiment. The range shooting system 1 includes targets 3 comprising sensors 15, target CPUs or controllers 16, muzzle detector 20, a butts higher power RF link (re-transmitter) 21, a mounds high power RF link (re-transmitter) 22, spectator terminals 23, a scorer terminal 24, shooter terminals 25, a printer 26, a web server 27, web accessible device/computers 28, barrel shooter A 29, and barrel shooter B 30. A shooter fires a projectile 2 (best shown in FIGS. 2 & 3) from a firearm at a target 3. The projectile travels towards the target 3, typically at supersonic speed. The projectile 2 pierces a front face 4 of the target 1 at a particular location. The shooter is assigned a score depending on the location of the piercing point with respect to the centre of the target.

The system 1 detects and calculates the exact shot position being the coordinates of the piercing point on the front face 4 on the target 3. This information is transmitted back to the mound (location of the shooter), so that the shooter can see the shot position represented graphically or numerically.

Figure 2:
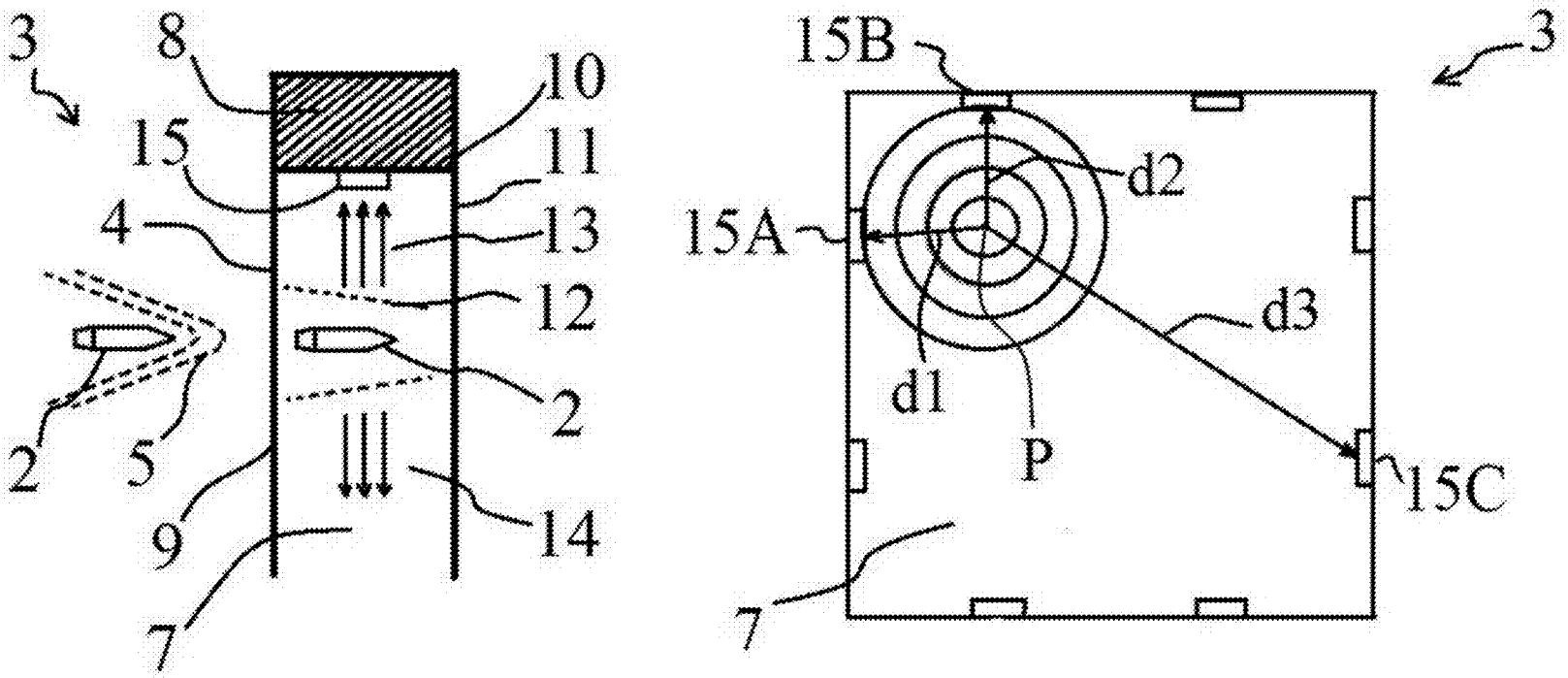
FIG. 2 is a side view and front view of the target chamber of FIG. 1.

FIG. 2 shows a projectile 2 approaching a sound chamber and generating a shock wave. The shock wave radially propagates towards the sensors, with the time being proportional to the distance from the impact to the sensors. As best shown in FIG. 2, while travelling at supersonic speed the projectile 2 produces the shockwave 5, which propagates in a circular pattern with respect to the surface of the target 3 with the centre (P) at the shot position. The shockwave 5 has a conical shape. The angle of its opening is wider when the supersonic projectile speed is lower. When the shot is fired not perpendicular to the target surface, the detected result may have an error due to non-circular projection of the cone to the surface of the target.

Also the wind causes the error due to a shift in the wave position. To eliminate these errors a sound chamber 7 is used. The sound chamber 7 consists of the rigid frame 8, enclosed by front and rear rubber membranes 9 and 10 at the front face 4 and the back face 11 of the target. The membranes cut and reflect the external sound waves 12, so as soon the projectile enters the chamber it generates new radial waves 13 & 14. These waves 13 & 14 travel towards to pressure wave sensors 15. The pressure wave sensors 15 are in the form of microphones but it will be appreciated any preferred pressure wave transducer may be employed, for example, an ultrasonic transducer; pressure sensor, magneto-electric sensor, shock sensor, or seismometer.

The projectile 2 pierces the front 4 and the back 11 rubber sheets of the target frame 8. While travelling inside the chamber 7 the projectile produces either a sound wave 5 or a shock wave 5 that rapidly loses energy and becomes a sound wave with the sharp front 6. The sound wave travels 5 inside the chamber 7 in a circular (cylindrical) pattern with the centre (axis) at the point (P) where the projectile pierced the front face 4. The sound wave 5 inside the chamber also reflects off the membranes 4 and 11, which helps to preserve the shape and energy of the wave 5. The sound wave 5 reaches the sensors 15A, 15B, 15C at time nearly proportional to the distance (d1, d2, d3) between the piercing point and the sensor 15. This time also depends on the temperature of air in the chamber 7. Other factors such as pressure, humidity etc. do not as significantly affect the speed of the shock wave 5.

The target frame 8 is made from 12 mm plywood and has hollow structure with interlocking of component parts to form the whole frame 8. This reduces the weight but maintains the rigidity of the frame 8. The target membranes 4 and 11 are formed from a sound reflective (or absorbing) material such as Firestone EPDM Rubber Pond Liner sheet. However, any preferred ethylene-propylene-diene monomer based rubber sheet can be used. Such is resistive to the ultraviolet radiation and oxidation. When the projectile 2 penetrates the front and rear rubber sheet faces 4 & 11, a small hole is left. The centre of the rubber membranes 4 & 11 deteriorate over time as more projectiles 2 pierce them. The rubber can be patched, for example with chutex rubber, as this appears to have sufficient resistance to stretch and tear from the projectiles 2.

Electrical wiring around the target 3 is equally distributed on the front plane (the front face 4) so in case projectile 2 hits the frame 8 it could not damage more than one single sensor cable allowing the target 3 to remain functional. The target controller 16 or CPU (preferably a microprocessor) controlling the operation of the target 3 is mounted on a swivel plate allowing the controller to be hidden and locked during transportation. In this way, the controller/CPU 16 (client) is stored in the chamber 7. The swivel plate is unlocked and hung down below the target, preferably at or adjacent ground level during shooting activity to keep it protected against being hit by a projectile 2.

To reduce effect of external temperature on the target chamber 7, the frame 8 is preferably filled with temperature insulation material. A corflute is preferably used over the front 4 and the back 11 target faces to create an insulating air space in between corflute and rubber 4 & 11. This significantly reduces the heat effect on the rubber faces 4 & 11 and the chamber 7 as well as advantageously reducing any UV damage of the rubber faces 4 & 11.

The CPU 16 receives information from the sensors 15 and performs calculations, manages sensing the timing intervals, reads the temperature in the chamber 7, controls operation of all the sensors 15 and controls the communication protocols for sending information from the target 3. The CPU 16 uses reed switches (magnetic switches) or hall effect sensors as the user input interface so that no mechanical opening is required for target frame configuration. The target 3 can be assigned any number with the contactless switches by magnet. Every target frame 8 is powered by an individual battery and runs its own WiFi server via the CPU 16 where each target is truly stand-alone by their purely wireless communications nature. This is advantageous and hitherto unknown.

Each target frame 8 is connected to the system 1 wirelessly and independently so that no cables are needed to be on or across the range. The CPU 16 manages the event FIFO that can be read by any number of clients. The FIFO keeps records for a predetermined number shots. The clients can read the entire FIFO at any moment. The FIFO increases reliability of the system 1 in case of temporary communication loss because the clients can retry and re-read the shot information from the current and older shots.

The sensors 15 are in the form of a microphone but can be another sound sensitive element such as ultrasonic transducer, pressure sensors, magneto-electrical, shock sensor, etc. The signal from each microphone sensor 15 is amplified filtered, and converted to a digital form before it sent to the CPU 16 so that the system is processing analogue signals to digital inside the sensor box/target frame and transmitting the digital information only from each sensor 15 to the CPU 16 for analysis (see the sensor block diagram of FIG. 4, which includes amplifier 41, high-pass filter 42, detector 43, level comparator 44, sensor dumping control 45, sensor feedback control 46, and digital temperature sensor 47). This increases electromagnetic immunity of the system 1 to unwanted interference. Known handheld communication devices and radars are known to interfere with signals at a range. For example, muzzle speed detection equipment can be interfered with by a cellular telephone. In system 1, only digital information is transmitted from the target 3 removing potential data corruption from electromagnetic sources of interference.

It will be appreciated that the system 1 also allows the CPU 16 to apply a correction to the amplifiers/filters in correspondence with the distance of a shooter to a target. It also advantageously allows previously received sensor signal properties to be compared and corrected for by the CPU 16. Such sensor signal properties include, but are not limited to, background noise, received signal strength and dynamic range amongst others.

The CPU 16 analyses the sensor 15 signals, captures the time of each signal, applies any correction to the amplifiers/filters, dampens the ringing of the sensors and performs a preliminary analysis for each possible sensor triplets (i.e. each possible combination of 3 sensors from all sensors 15). The CPU 16 prepares to send raw data for further analysis to the main range CPU 17. Every target 3 can have more than four sensors in arbitrary positions. Preferably, however, the sensors 15 of system 1 are positioned symmetrically (see FIG. 2) to reduce the effect of possible incorrect speed of sound estimate to the final result.

Figure 3:
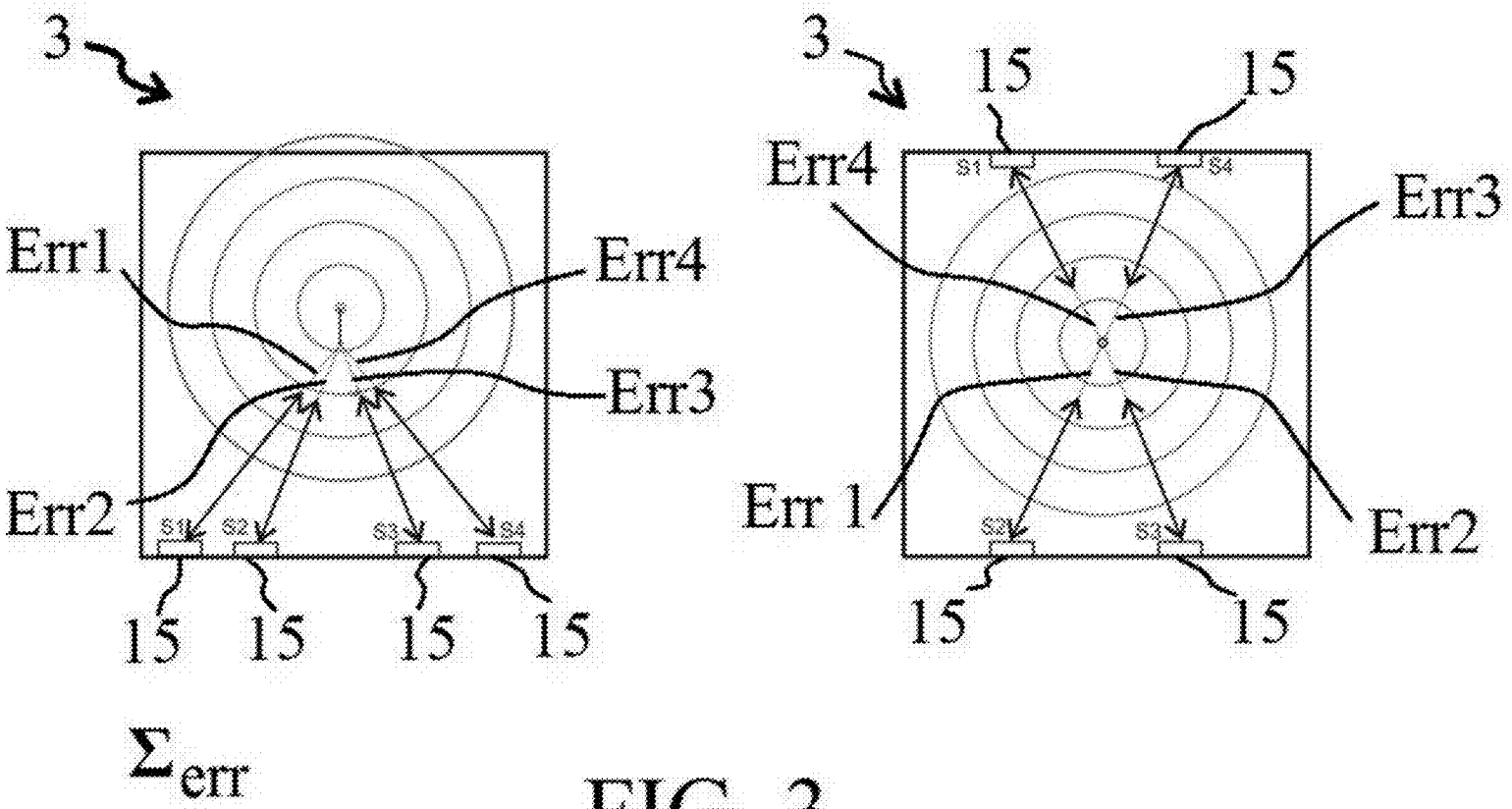
FIG. 3 is a diagram showing the errors introduced into the system by non-symmetrically disposed sensors in the system of FIG. 1.

When the shot position is closer to the centre the speed variation errors cancel each other when the sensors 15 are symmetrically disposed. This is best shown in FIG. 3. FIG. 3 shows how temperature variation introduces sound speed variation, which adds error to the measurements in the case of non-symmetrical sensor positions (left picture). In the case of symmetrical sensor positioning the error compensates. The ErrX is the sensor No X error, which are introduced by sound speed variation due to the temperature variation. The right hand side of FIG. 3 shows that in case of symmetrical sensor 15 position how the errors cancel each other.

Figure 4:
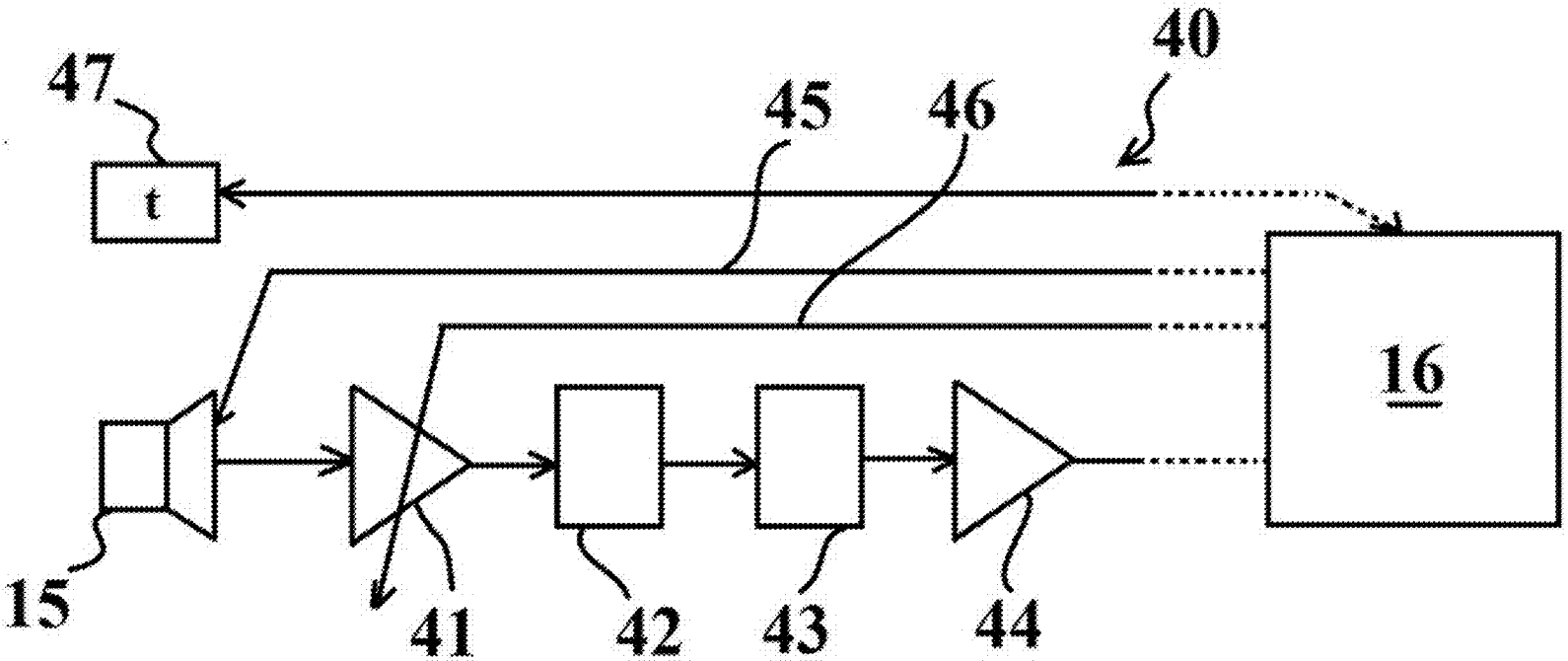
FIG. 4 is a circuit diagram of the sensor connection to the target controller in the system of FIG. 1.
Figure 5:
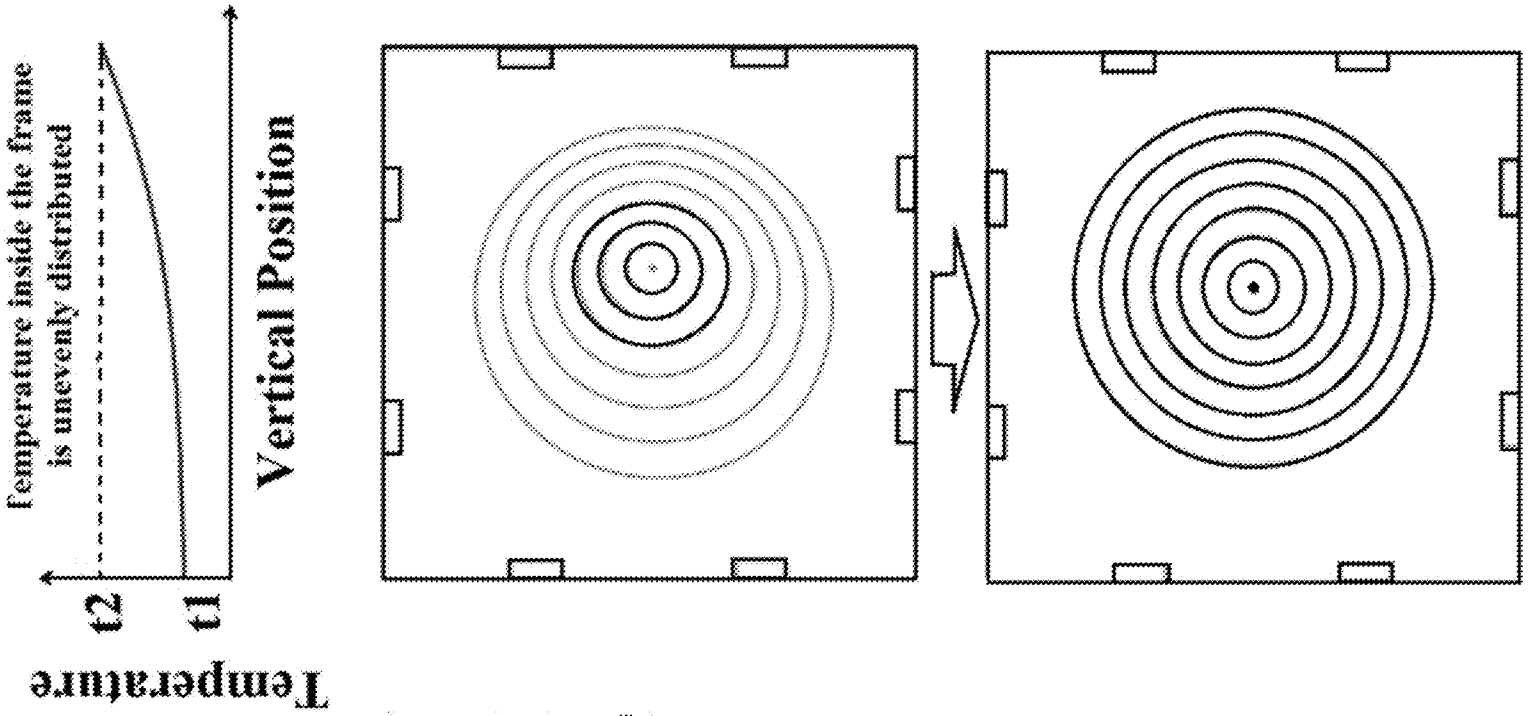
FIG. 5 is a schematic diagram showing the effects of a temperature variation in the target chamber of the system of FIG. 1.

The chamber 7 also includes digital temperature sensors (t) (see FIGS. 4 & 5; FIG. 5 shows how the temperature inside the target is not uniformly distributed, especially on a hot sunny day. The system 1 compensates this error) such as a semiconductor or resistive element, or a dissimilar metal thermocouple. The CPU 16 also measures or receives the information from these temperature sensors for further calculation of sound speed based on temperature.

The system 1 employs a number of processes which allow the system 1 to function accurately and reliably. While no shots are detected the target CPU 16 remains in waiting mode.

In this mode the CPU 16 waits for an input capture interrupt to arrive informing it about a sound wave hitting the sensors 15. As soon as the first interrupt is detected the CPU 16 moves to a shot capture mode. The CPU 16 remains in this mode until either all sensors 15 are triggered or an amount of time sufficient for all sensors 15 to receive a signal from the waves 13 & 14 has elapsed. This time is typically the top estimate for the amount of time requested for the slowest expected wave 13 & 14 (at coldest temperature to traverse the diagonal of the target 3).

After that the CPU 16 switches to "deaf" mode when all inputs from sensors 15 are ignored. This mode is necessary to prevent false shot detection while the sensors 15 are repeatedly triggered by the sound wave reflecting off the interior walls of the chamber 7. This is known as a 'ringing effect' and necessitates the CPU 16 ignore inputs from the sensors 15 right after the shot is detected. The "deaf" period depends on the mechanics, configuration, and materials used in the target 5, but typically is on the order of 5 to 50 milliseconds. Before, after, or during the "deaf" mode the CPU 16 performs analysis of the captured sensor 15 information. A contra-phase signal can be applied to the sensors 15 to physically minimize any ringing effect.

This information from the sensor triggering event includes an array of sensor numbers and timestamps of sensors 15 triggering the CPU 16. The CPU 16 sorts the sensor triggering events by the time of arrival and forms a packet of information to send over to the main (range) CPU 17. The packets include target information (target number etc.), and a sequence of sensor 15 number and time difference between the current sensor 15 and the first sensor 15 triggered. The CPU 16 uses an input capture method to determine the time difference between actuation of every sensor 15. The CPU 16 also uses the analysis to compensate for any background noise depending on shooting distance and to damp the sensor to reduce after-shock ringing time, so as to make the target 3 'deaf' for a certain period of time.

The information packets are transmitted from the target CPU 16 to the range CPU 17 but it will be appreciated that the system 1 can have data processed on client CPUs 16. The range CPU 17 reorganizes the data to get all possible 3-sensor combinations out of all sensors 15 triggered. For example, if all eight sensors 15 shown in FIG. 2 are triggered, there will be (${}^{8}C_{3}$=) 56 combinations of 3 sensors. The range CPU 17 uses an algorithm to calculate the expected piercing point on the front face 4 by applying a centre calculation to each triplet of sensors 15. The centre calculation algorithm uses an analytical formula to derive a hyperbolic curve for each sensor triplet set of data and an intersection of 2 or more hyperboles provides the piercing point. Advantageously, this allows an unlimited number of sensors 15 to be used without significant increase CPU 16 load and power.

It will be understood that these combinations each define a "basket of data". For example, a basket is formed from the data provided by the combination of the first, fifth and sixth sensors and each of the other combinations of three sensors provide the other 55 baskets in the present 8 sensor example. This provides a spread of baskets. If one particular sensor is in error, then this propagates to all baskets having data from that sensor. This provides baskets with different spreads where the spread is proportional to the size of the error in the sensor. In this way, data from a defective sensor can be rejected and all combinations involving that sensor deleted. A re-calculation can then be made without the data from the identified defective sensor. Further, the level of spread of the baskets can be predetermined as desired.

The following algorithm is used in the preferred embodiment to calculate where the expected point of impact is based on the time difference of arrival of the wave to three sensors. The algorithm is presented in Java, but can be implemented in any programming language:

```
private static Point hitPoint(Point s1, Point s2, Point s3, double d21,
double d31)
{
    // Initial coefficients.
    double k1 = s1.x * s1.x + s1.y * s1.y;
    double k2 = s2.x * s2.x + s2.y * s2.y;
    double k3 = s3.x * s3.x + s3.y * s3.y;
    double f1 = (d21 * d21 − k1 + k1) / 2.0;
    double f2 = (d31 * d31 − k3 + k1) / 2.0;
    double x21 = s2.x − s1.x;
    double x31 = s3.x − s1.x;
    double y21 = s2.y − s1.y;
    double y31 = s3.y − s1.y;
    // Invert 2x2 matrix.
    double div = x21 * y31 − x31 * y21;
    double a = − y31 / div;
    double b = y21 / div;
    double c = x31 / div;
    double d = − x21 / div;
    // Group numbers for quadratic equation.
    double xc = a * f1 + b * f2;
    double yc = c * f1 + d * f2;
    if ((d21 == 0) && (d31 == 0)) {
        return new Point(xc, yc);
    }
    double xr = a * d21 + b * d31;
    double yr = c * d21 + d * d31;
    // Solve quadratic equation.
    double discr = Math.sqrt(br * br − 4 * ar * cr);
    double root1 = (−br − discr) / (2 * ar);
    double root2 = (−br + discr) / (2 * ar);
    double root = ((root2 < 0) || (root2 > root1)) ? root1 : root2;
    // Substitute the coefficients.
    f1 += root * d21;
    f2 += root * d31;
    return new Point(a * f1 + b * f1, c * f1 + d * f2);
}
```

Multiliteration Algorithm which is Used to Determine the Impact Position Based on Timing Difference The input parameters consist of three points s1, s2, s3 and two numbers d21, d31. The points are pairs of (2-D) coordinates x and y of each of the 3 sensors 15 that detected the wave in the particular three-sensor triplet combination. The coordinate system can be arbitrary but is preferably chosen in such a way that the centre of coordinates (0, 0) is located at the centre of the target face 4. Axis y is the vertical axis along the front surface of the target pointing upward. Axis x is the horizontal axis pointing to the right. d21 is the difference in the distance that the wave (13 or 14) has travelled between the impact point P on face 4 and to sensor 15B and sensor 15A. d31 is the difference in the distance that the wave has travelled between the impact point to sensor 15C and sensor 15A. d21 and d31 are calculated by multiplying the time difference between arrival of the wave 13 or 14 to corresponding sensors 15 by the speed of sound. The results of calculations from each triplet are then combined to produce the final estimate of the shot position.

A frame 7 temperature measurement system is also used. This employs two or more temperature sensors which allow the CPU 16 to measure and interpolate the temperature gradient inside the chamber 7. A correction factor can then be applied to compensate for the temperature variation inside the chamber 7 due to uneven heating.

The speed of sound is calculated by first averaging (or applying a gradient algorithm) to the temperature values from the temperature sensors. The speed of sound approximation formula is then applied to the temperature. For example:

$$\upsilon = 331.5\sqrt{1 + \frac{t}{273.15}}$$

where υ is the speed of sound in m/s and t is the temperature in ° C.

The temperature inside the chamber 7 is unevenly distributed. The top of the chamber 7 can be more than 10 degrees above the temperature in the bottom (left graph on the FIG. 5). As a result the sound travels faster at the top than the bottom and an additional error is introduced (the middle picture showing the scoring ring disturbances due to the temperature variation). Employing several vertically spaced apart temperature sensors makes it possible to compensate for the internal temperature profile of the chamber 7 and correct the error.

The algorithm uses the 3-sensor impact position algorithms for all combinations of 3-sensors out of all the sensors 15 that have been triggered by the wave 13 or 14. The range CPU 17 then preferably averages all the values to get the approximated point of impact. However, it will be appreciated that any preferred statistical method to further improve accuracy of the impact point estimation can be used as desired.

When the system 1 uses a target 3 having five or more sensors 15 this generates a significant amount of redundant information. This redundant information is used to correct sensor error and to increase the accuracy by applying a statistical calculation in real-time for every shot. This can be easily achieved by the range CPU 17 or a client CPU 16.

The redundant information can be used to reject incorrect or inaccurate data from any sensor 15 in case of such event (for example, if a sensor 15 or wire to the CPU 16 is damaged). Since the system 1 typically receives information from all eight sensors 15 shown in the preferred embodiment, deviation from average for each individual sensor 15 can advantageously be calculated in real time. This is preferably achieved by calculating the sum of distances (or distances squared) from the average position calculated from the 3-sensor combination triplets that exclude and include each particular sensor 15. Then if the calculated deviation from the average for a sensor/s 15 is significantly larger than from the other sensors 15, such sensor/s 15 can be excluded from the calculation of the estimate of the shot position.

Figure 11A:
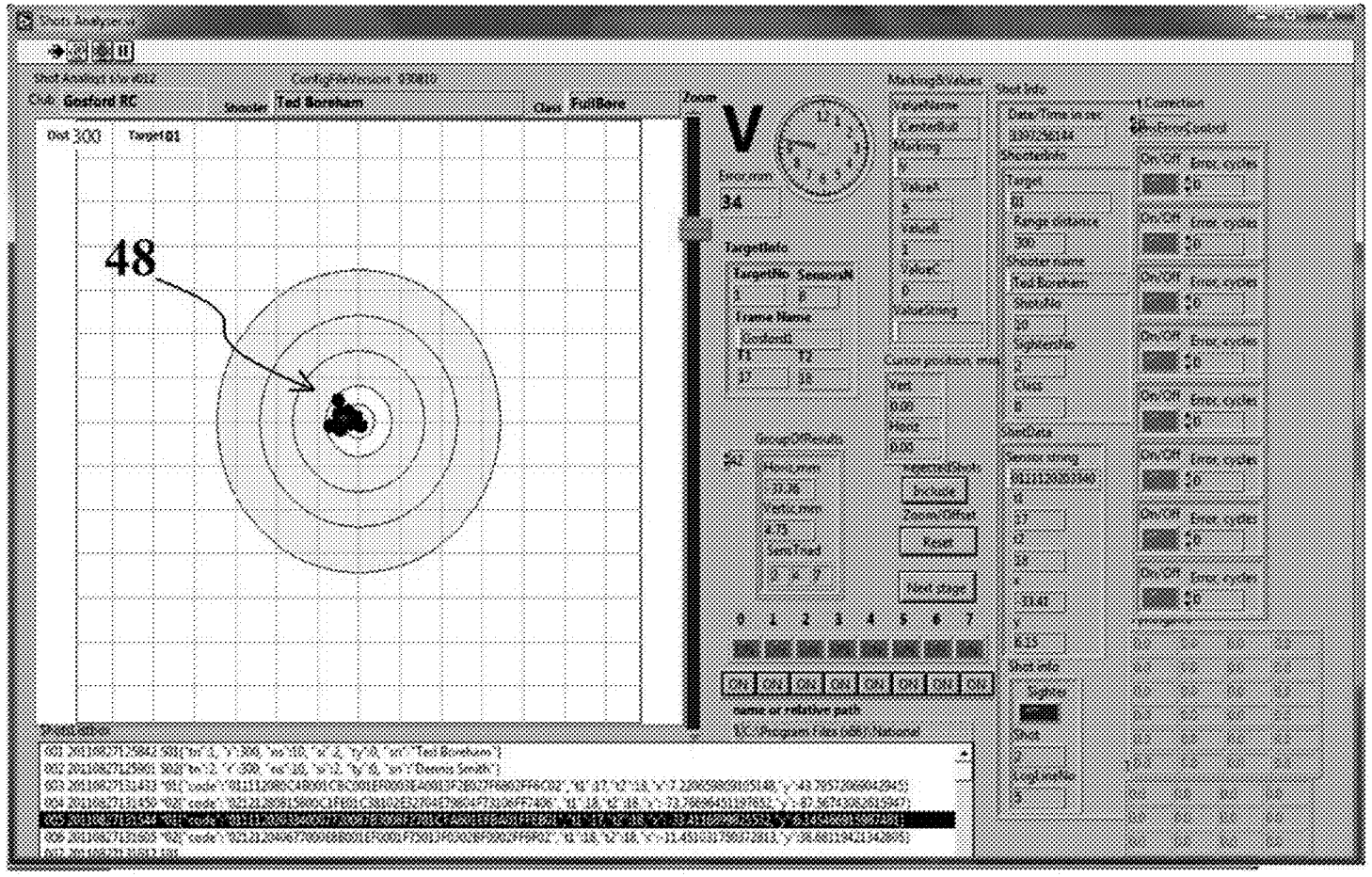
FIGS. 11A to 11J are various simulated screen shots showing an example of calculation of projectile target position in the system of FIG. 1.

FIGS. 11A to 11J show an example of the accuracy improvement using the system 1. In the preferred embodiment, all eight sensors 15 detect a shot. This is corresponds to 56 unique combinations of 3 sensors (triads 48), as noted above. A screen shot of a monitor output for a target 3 is shown in FIG. 11A. This shows the real shot having some unrealizable data from the sensors 15. A grey cross is shown on the target and this corresponds to the 2-dimensional average centre of these combinations.

Figure 11B:
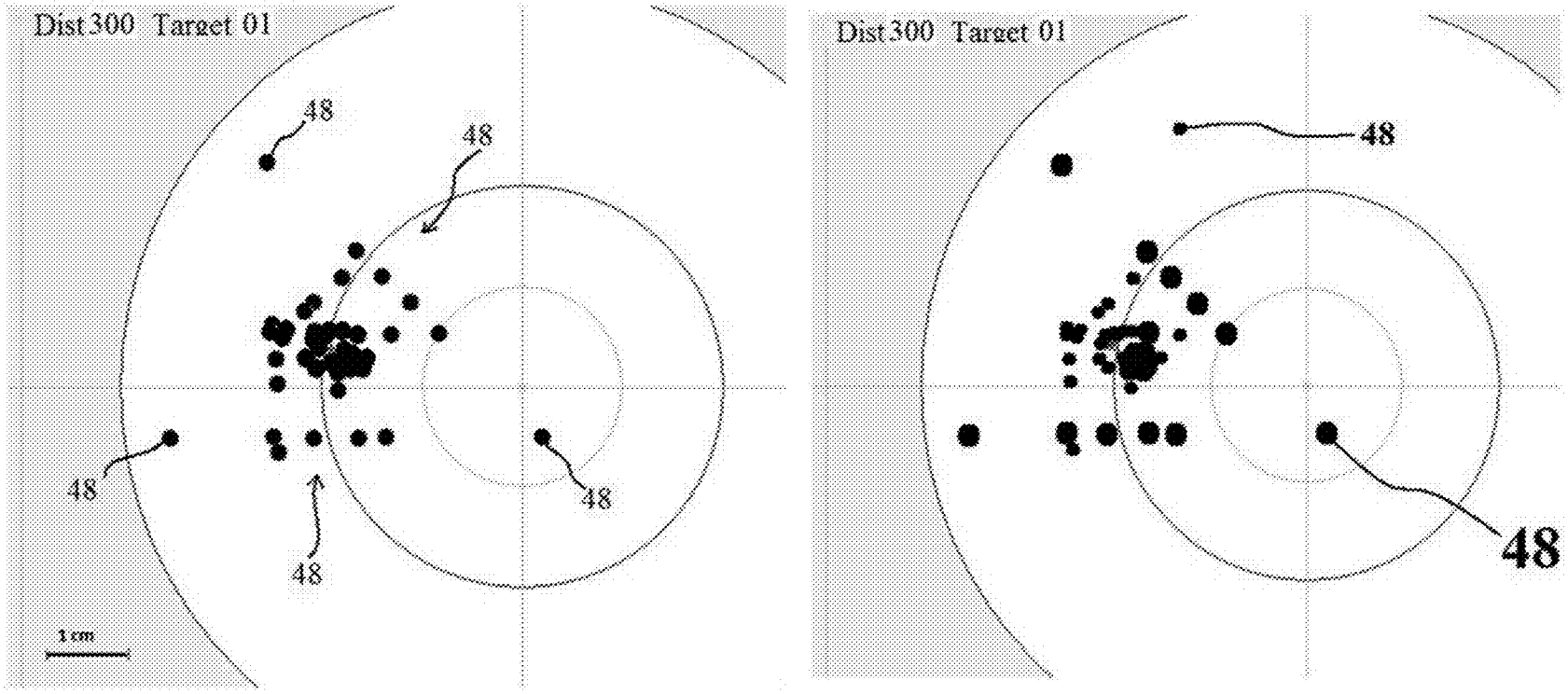

The "Error" field in the screen display shows the distance from the calculated shot to the target centre (this is as opposed to the shot analysis error). As can be seen in FIG. 11A, the shot hit the target 34 cm from the centre. The zoomed data in FIG. 11B shows the group of all "triads"/three sensor combinations. An analysis of the impact of each sensor to the error and selected sensor (sensor 7 in the example shown), which has results with the greatest deviation (shown in larger text and larger dots in the right hand side of FIG. 11B).

Figure 11C:
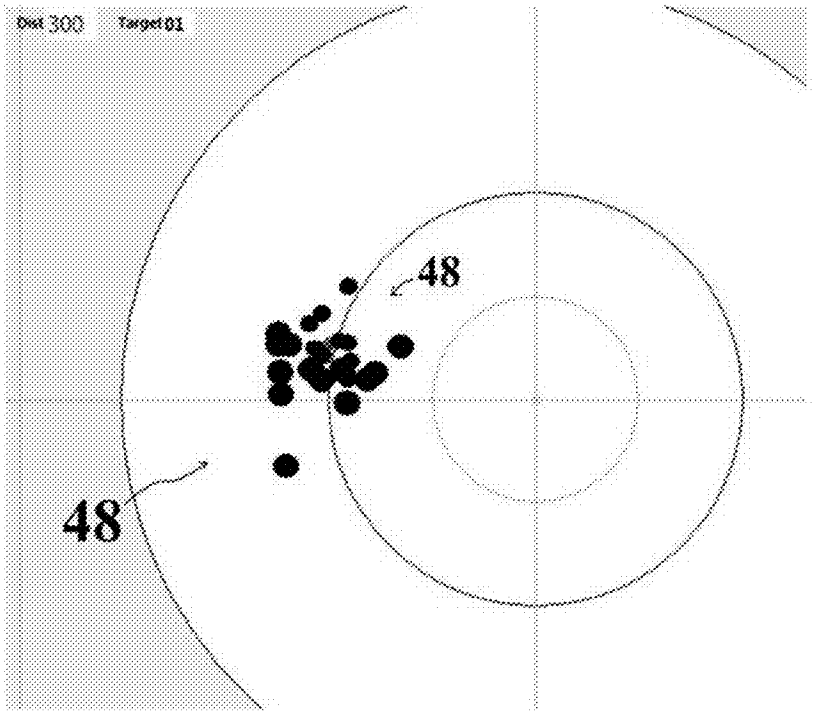
Figure 11C:
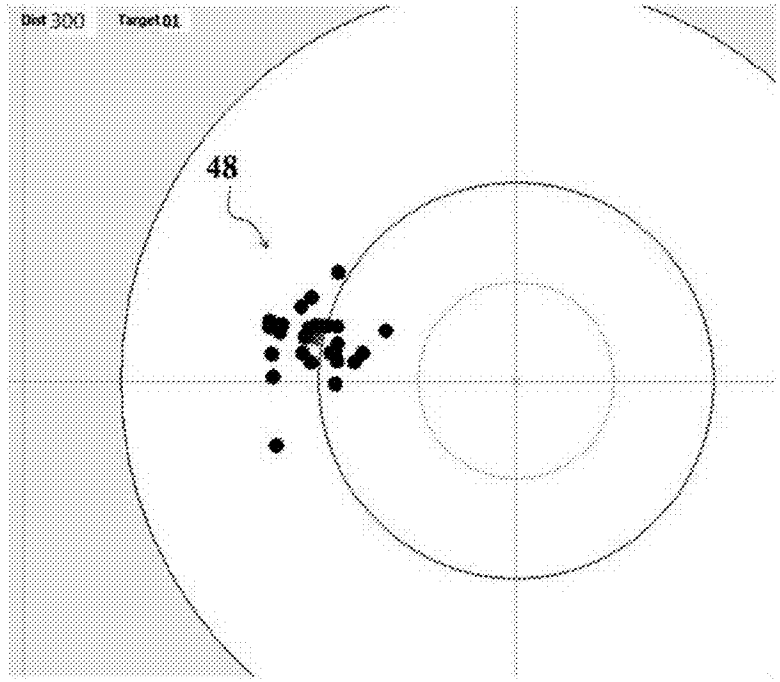
Figure 11D:
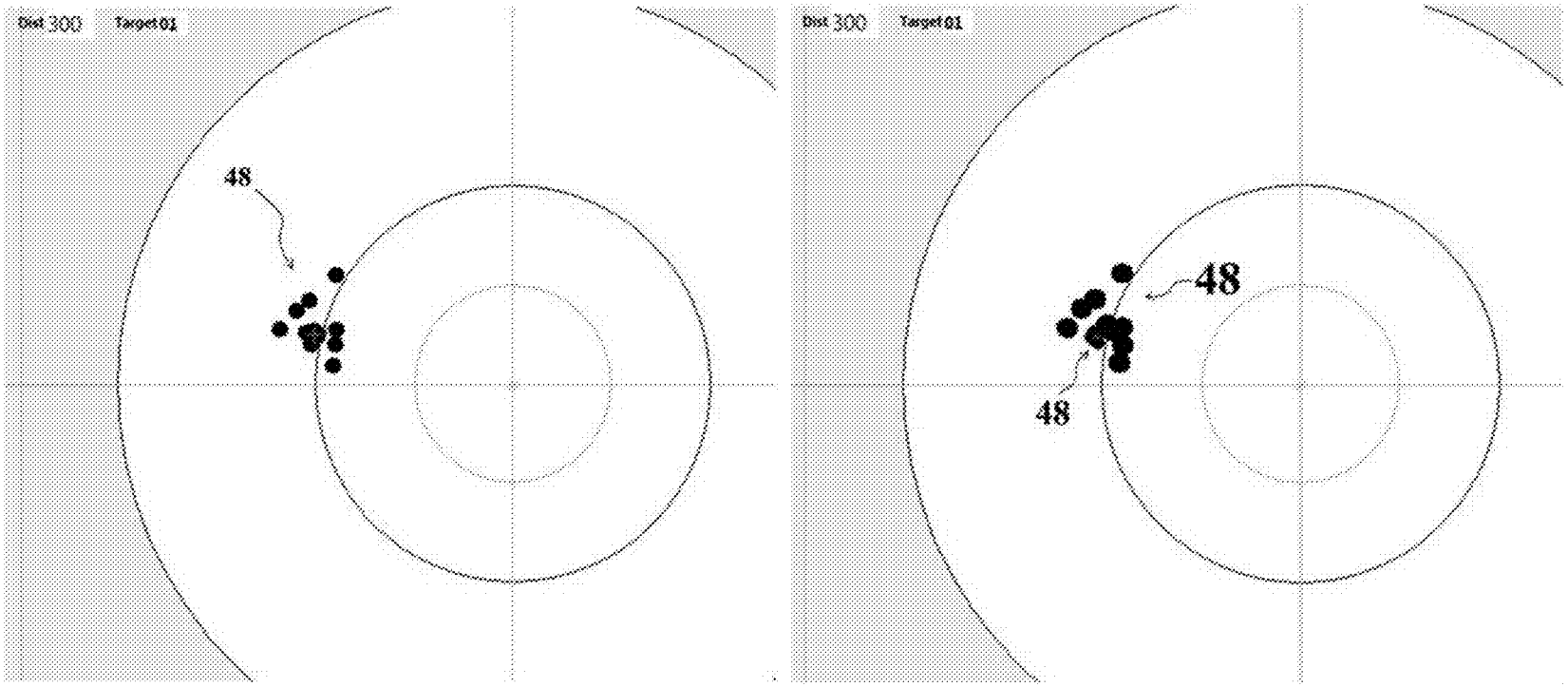

This sensor 15 (the seventh of the 15 sensors) is then excluded from further calculations (see the left hand image of FIG. 11C). The same method is applied to the next sensor. In the example of the preferred embodiment, this is sensor number 5 which has results with the greatest deviation (larger number and larger dots on the right image of FIG. 11C). This sensor number 5 is also excluded from further calculations. The same method is applied to the next sensor. In the preferred embodiment this is sensor number 3 which has results with the greatest deviation (shown in larger number and larger dots on the right image of FIG. 11D.

Figure 11E:
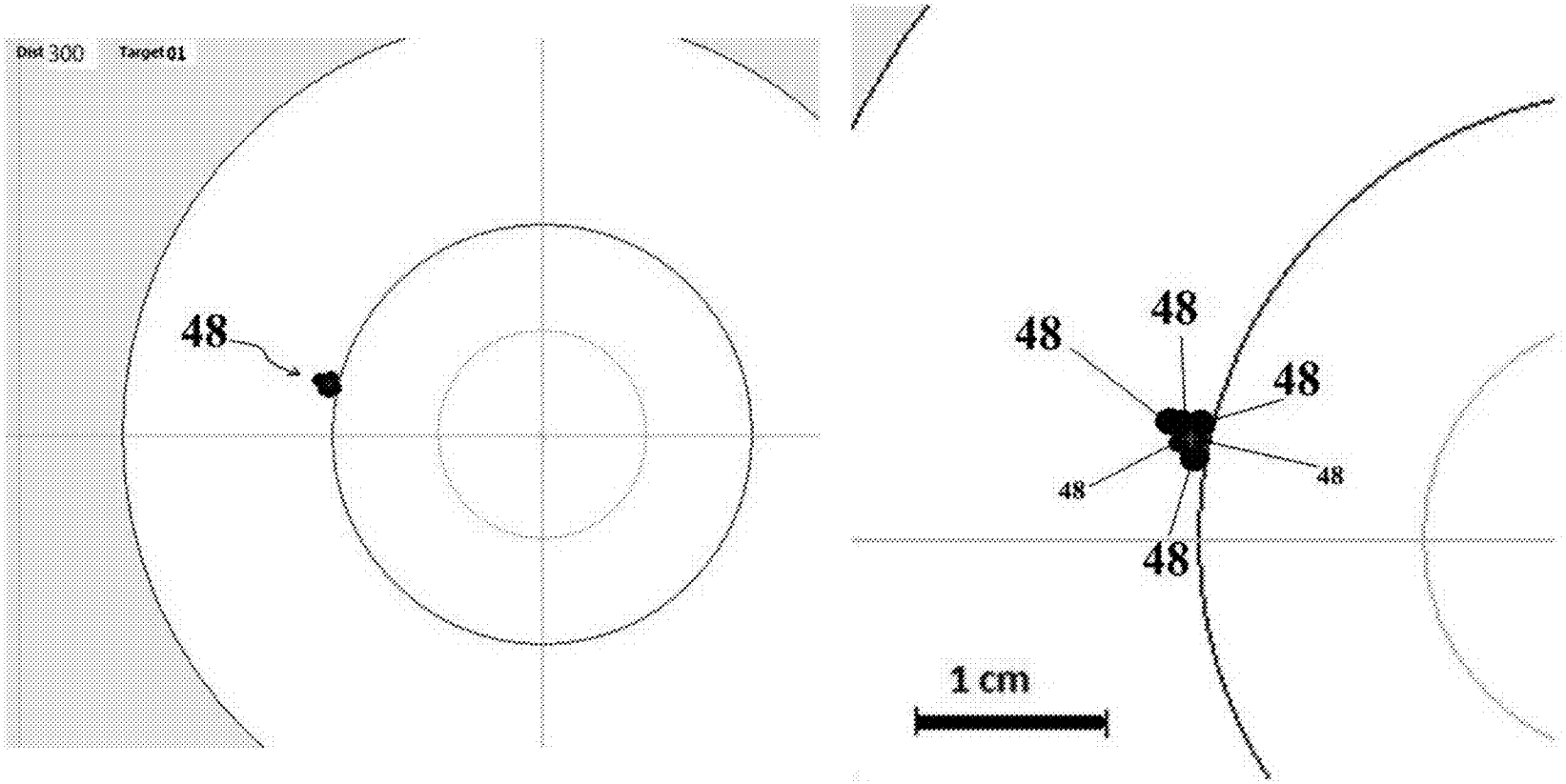

This sensor number 3 is then excluded from further calculations (see left image of FIG. 11E). FIG. 11E shows the combination of five sensors numbered 0, 1, 2, 4, 6 with rejected non-reliable results from sensor 3, 5, 7. A magnified version of the combination of the 5 reliable sensors is shown on the right of FIG. 11E.

Figure 11F:
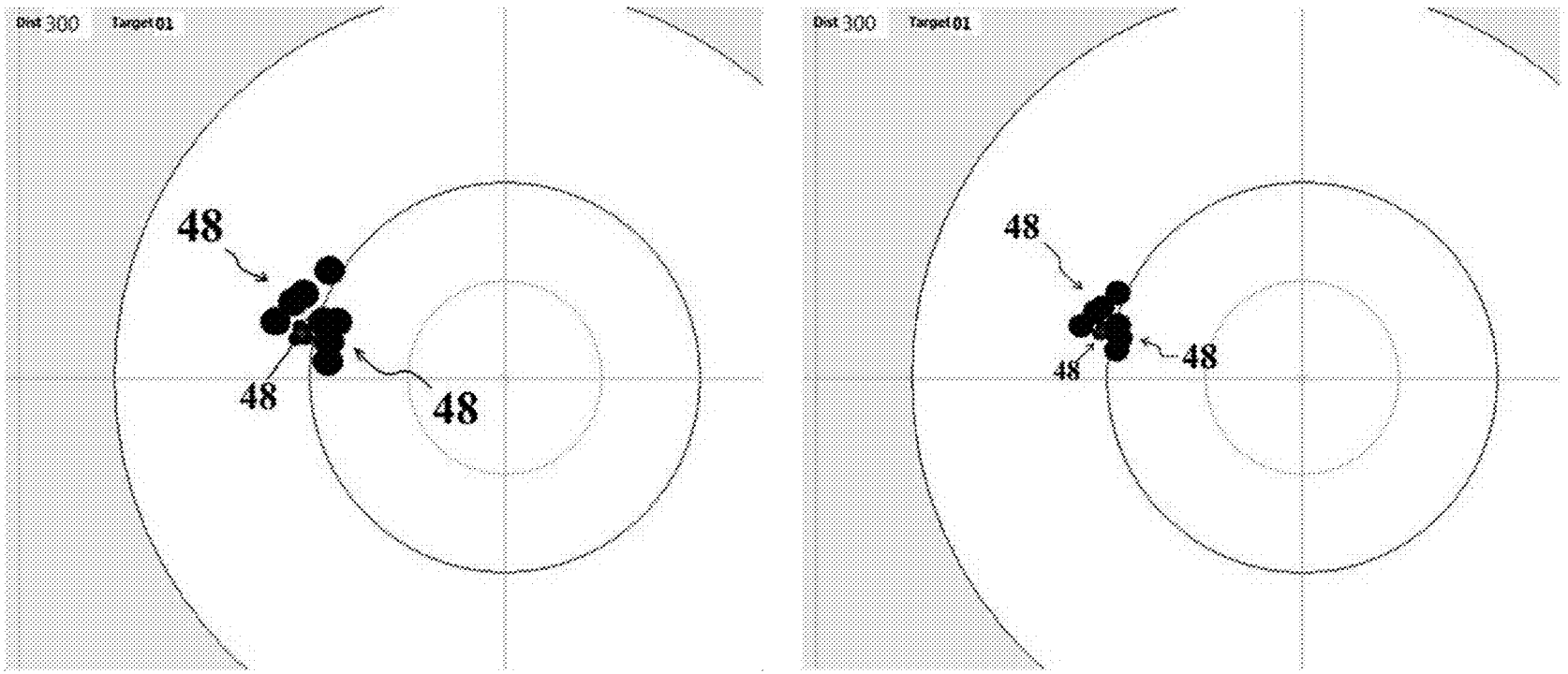

From the results of the analyses above an of error (3 mm) was eliminated. It will be appreciated that in competitive shooting, 3 mm is significant. The data achieved during this analysis is used for automatic correction of the system 1. First, the system identifies the errors for each sensor 15. FIG. 11F shows error minimization of sensor number 3. The left image shows the original data for sensor number 3. The right picture shows a half-way corrected sensor (shown for illustrative purposes).

Figure 11G:
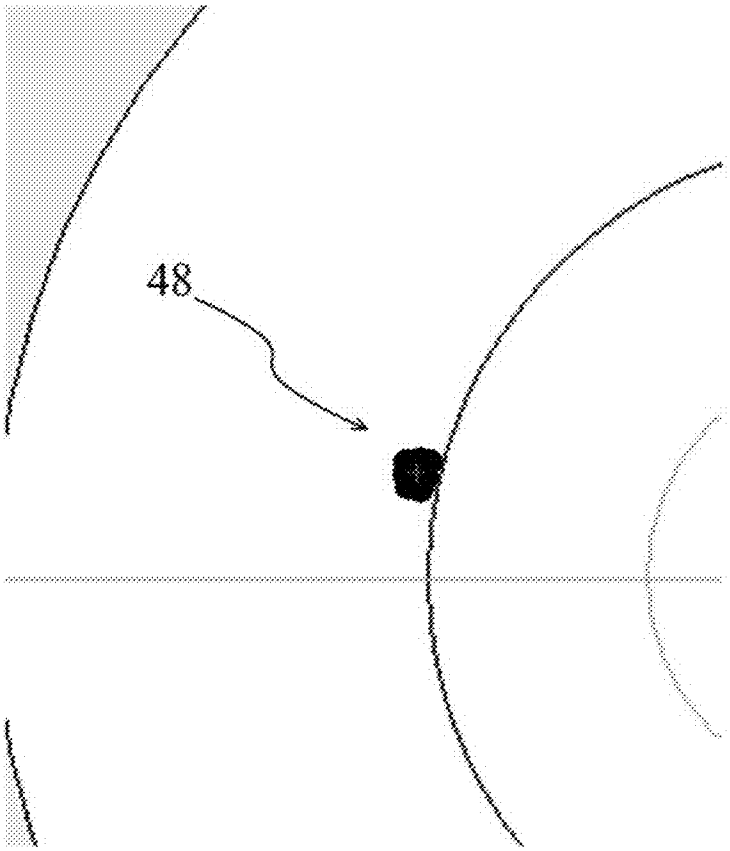
Figure 11G:
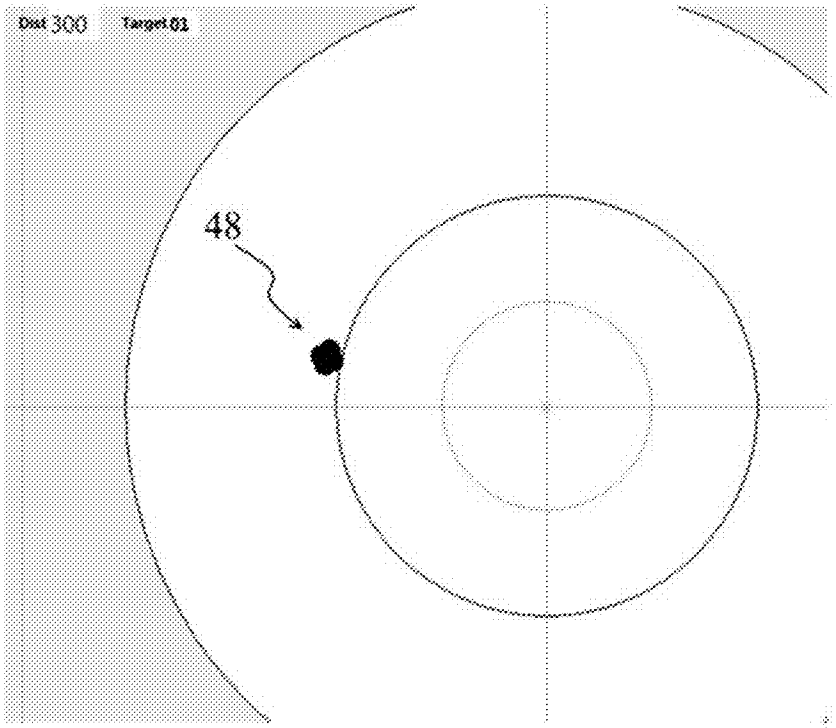
Figure 11H:
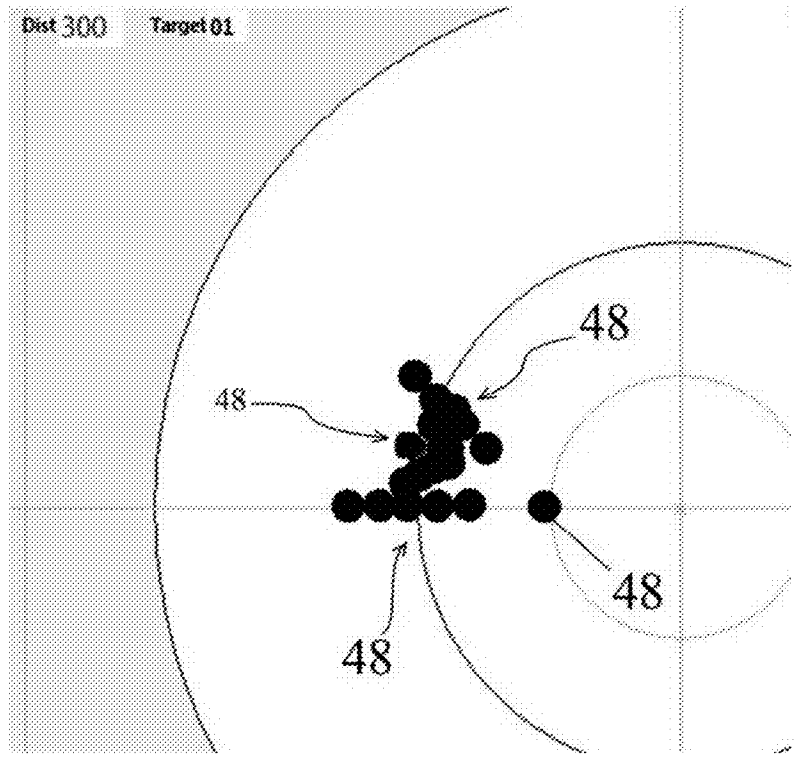
Figure 11H:
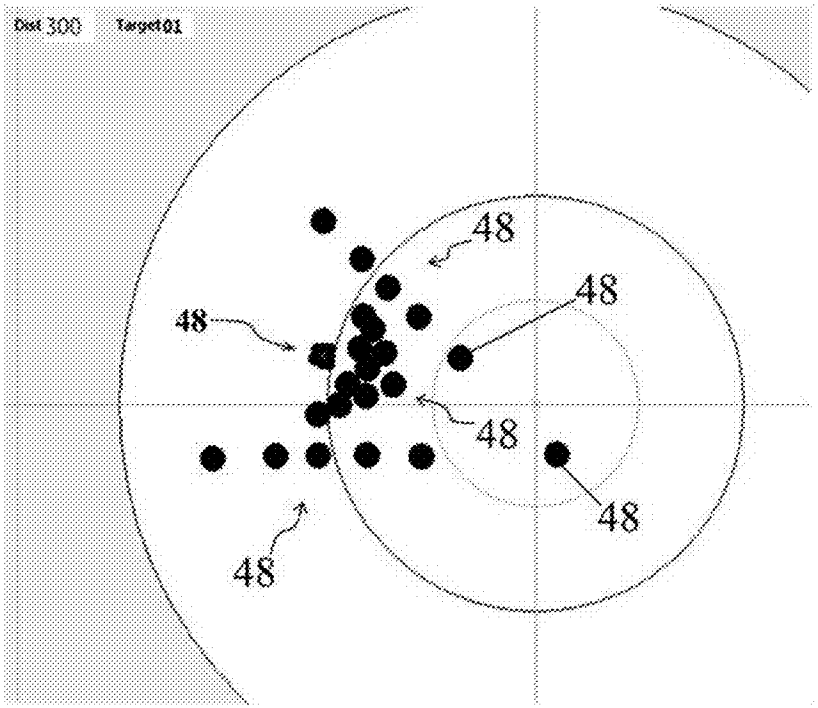
Figure 11I:
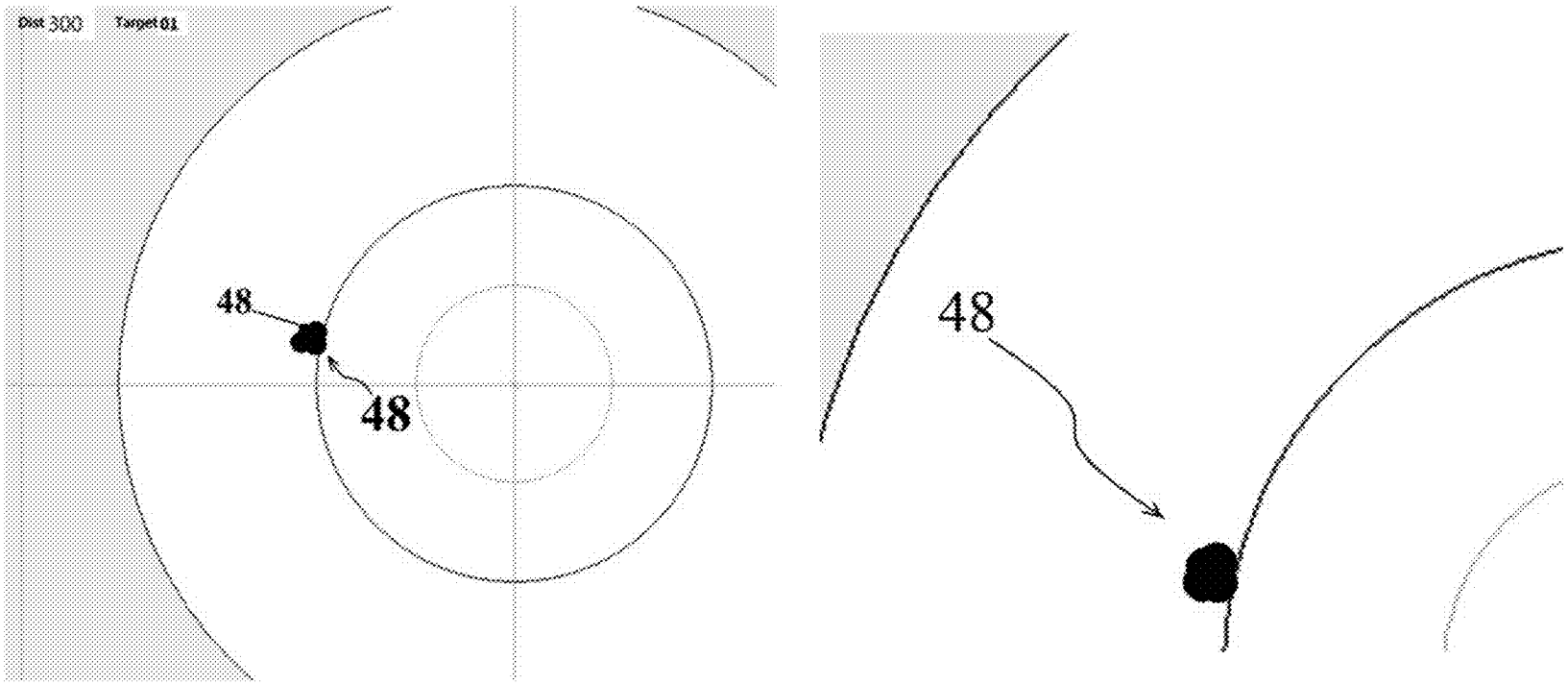

FIG. 11G shows the fully corrected sensor number 3 data. The individual dots are not clearly observable as they are printed on the top of each other. The same method is applied for the sensor number 5 (not shown here) and then for sensor number 7 (shown below in FIG. 11H). The original data for the sensor number 7 is shown as larger dots in FIG. 11H, and example of half way corrected data for sensor number 7 (right image of FIG. 11H). The corrected data for all sensors 15 (including corrected sensor numbers 3, 5 and 7) are shown in FIG. 11I where the right hand image is a magnified view of the right hand image.

Figure 11J:
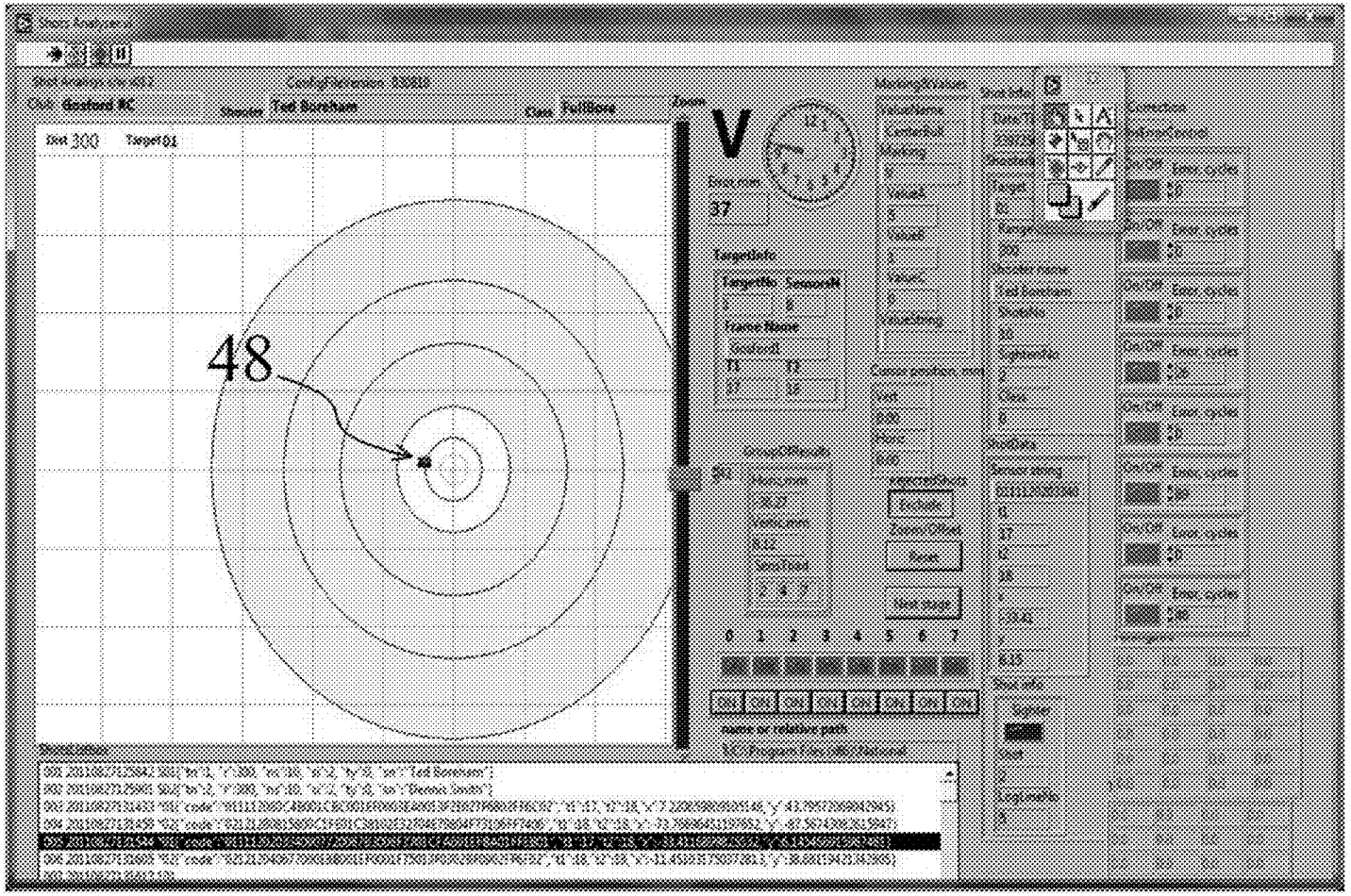

The corrected shot and sensors data on analysis software is shown in the example screen shot of the system 1 shown in FIG. 11J. After the data analysis above when the errors are eliminated, the "Error" field shows that the shot actually hit the target 37 mm form the centre and not 34 mm as indicated before the analysis is applied.

It will be understood the 3 mm correction can make the difference in competition as it would change the result form reported "V" to 5" indicating the projectile hit a scoring section of the target. The system 1 collects the error information for each shot and for each sensor 15, and when the system 1 has a sufficient number of data points the correction factor is applied to permanently correct and maintain the data from the sensors 15. The system 1 also reports the health of the system (or error reporting), which can be derived from the data deviation over a period of time.

Furthermore, the redundant information allows the system 1 to compensate for the physical position of a sensor 15 in the event it is replaced or is otherwise misaligned. This most advantageously allows self-calibration of the targets. It will be appreciated that the system 1 uses four or more symmetrically disposed sensors 15 as information is then provided indicative of a sensor being broken and five or more sensors provide data which uses redundant data to compensate for broken or defective sensors 15 thereby recovering otherwise lost data.

The above redundant information also allows the system 1 to automatically correct the errors in measuring the physical position of the sensors 15. As the system 1 accumulates the statistics from a large number of shots it becomes possible to detect and correct errors in coordinates of the sensors 15. In case the temperature sensors are missing or faulty, the system 1 may use an algorithm to approximate the speed of sound by the method of iterative minimization of the spread of values in the sensor triplet calculations and an adjustment for the temperature value estimate. The algorithm can start from an arbitrary temperature value, calculate the triplet calculation spread, then change the temperature value and recalculate the spread. The goal of such an iterative algorithm is to minimize the spread by a gradient decent to advantageously lower spread values.

The CPU 16 caches the sensor data and the results of its own calculations. The CPU 16 stores all information which is required to be transmitted until communication is established/re-established and information is requested by the range CPU 17 or an individual client (such as a shooter terminal). This will increase the system 1 reliability and not allow data loss in case of communication disturbance. As noted, all targets wirelessly communicate the data to a transmission hub which retransmits this to the range CPU 17. The use of fully independent and wireless targets 3 is not previously known and there are no interconnections between targets 3 in system 1. Of course, the ability of the target CPUs 16 to store and then transmit data allows shots not to be lost when a target 3 is disabled. Of course, mounting the target electronics and CPU 16 in an enclosure or mounting that can be swung or moved clear of the target 3 before use is most advantageous. The enclosure or mounting preferably swings downwardly towards or to the ground as far from the target 3 as practical. Further, the enclosure or mounting may also form a protective face for the target 3 during transport or periods of non-use.

The system 1 wirelessly transmits the calculated location of the shot to the shooter and/or the scorer. A spread spectrum communication technology is preferably employed and allows increasing reliability of communication and increasing immunity to single frequency radiation. The calculated position of the shot is drawn on a monitor. It will be appreciated that the system can determine the position of impact of a target and present this as a coordinate pair and/or presented as a graphically displayed target plot being a simulated target image with impact point.

The system 1 is completely wireless between target 3 and range CPU 17. The system 1 preferably uses Nanostation and enGenious devices Range communication and RedPine devices for targets WiFi communication with muzzle detection systems and the target 3.

Figure 6:
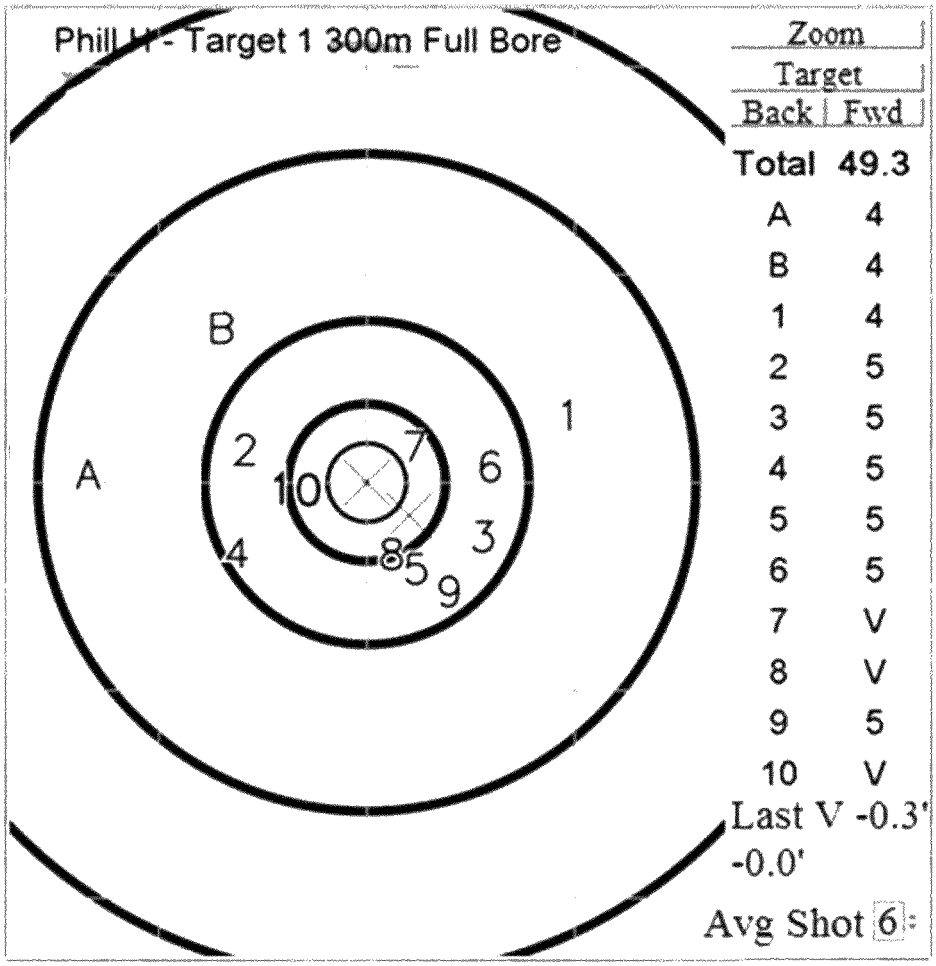
FIG. 6 is a screenshot from a spectator client terminal provided by the system of FIG. 1.

The system 1 preferably uses a web-based server. This allows an unlimited number of simultaneous station access (see FIG. 1). Advantageously, the shooting events can be monitored in real time by any clients (see FIG. 6, which shows a screenshot of a spectator's station/terminal) on the Internet and local network on the range. The results are stored in local database and propagated to the central database for future viewing and analysis.

The system 1 has a dedicated range server (controlled by range CPU 17) as best shown in FIG. 1. This CPU 17 has a multiple role in the system 1 as follows:

- monitor all activity on the range
- collect and maintain the information about the shots
- maintain the log with the information about the shots
- maintain the internet connection and responsible for real time web-site update
- maintain interconnection between the systems over the Internet to conduct real time inter-clubs competition
- maintain proper distribution of the informational log file between the internet web server, local client and the target frames.
- maintains and constantly monitors the health of the whole system and maintain the system log files.
- maintain the shooters registration and allocation the shooters to the target.
  - Shooters ID using RFID or QR technology which removes the need to identify shooters and the entry of information in a shooters queue and competitors do not need to swap cards.
  - Shooters ID using USB memory stick, which is also used as the storage for the results
- maintain the shooters queue order and transmit the information to the previously allocated to the shooters shooting location.
- Server has the capability to connect the printer to print the results.

The system 1 can therefore most advantageously communicate with any web capable device 28 so that even if the RF re-transmission link 21/22 is inoperable, any such web capable device or devices can be used in its place. Further, the almost ubiquitous Apple phone or Android Smartphone can be used, as can a Kindle reader, for example, which otherwise has limited uses. This can be used to keep the capital costs of the system 1 down.

The system 1 also preferably has the ability to display the shooting results over the Internet in the real time like the user is present on the range as spectator (see FIG. 1) for scoring purposes. A php written server supports the log management the same way as the local monitors do. The Range CPU/server 17 transmits data to the external internet web server 27. The server 17 manages the log and forms the web page. A javascript based web client periodically requests if the information was updated and if it was updated, it receives the updates and displays the updated page to the observer (see FIG. 6).

The system 1 most advantageously allows the conduct of real time inter-club competition over the internet while the Clubs have distinctly different geographical locations. In this case, the range servers 17 at each site are synchronized with a common log file via the central web-server. The system 1 also can broadcast the image from a range camera and shooter monitor built-in camera to the LAN and Internet.

The system 1 allows practical real time inter-club competitions conducted at two or more remote locations. This advantageously allows competitions to occur that otherwise would not be able to be organized, for example because travel costs or available time to travel. Logistical impediments will be removed to allow shooters to compete against others not at the same range at the same time. No know system allows this.

Dual monitor sets can be used in a spectator/shooter (see FIG. 1) and a scorer/master mode. As traditional shooting is currently set up, system 1 may have two modes for monitors: the master (scorer) and the shooters (spectator). The shooter mode is a passive mode where the shooter may observe where the shot goes but cannot control any input. The master is the mode which has the control over this shooter (i.e., to disclaim any shots, to cut sighters, or to alternate between miss-sighter-optional sighter-valid shot). This is advantageous since previously the scorer has been behind the shooter with their own monitor controlling all aspects of the shooting. With the present system 1, sighters (practice shots) can be rejected whereas previously they couldn't. Sighters can be labeled on the monitors with indicia not indicative of shots in competition. Further, system 1 allows scorer control since there is a controllable scorer monitor for each target 3 rather than having only a single monitor for the range as this was previously not available.

The system 1 has the advantageous ability to connect an unlimited number of wireless targets 3 and has, inter alia, the following abilities:

- Use of an ordinary web browser with commonly used Java script as the client software.
- Use any device, which has built-in browser with java script support (iPad, iPhone, laptops, TV's, fridges with I-Net capabilities) as the monitor.
- Systems can use eInk™ technology, which is adapted for viewing in sunlight and advantageously has no power consumption for non-changing images
- The system can use Pixel Qi™ technology is adapted for viewing in sunlight
- The system 1 can use OLPC laptop as the bases.
- Indicating the group using averaging of N (variable) last shots
- Employing the reversed method of score calculation (maximum possible)

Figure 7:
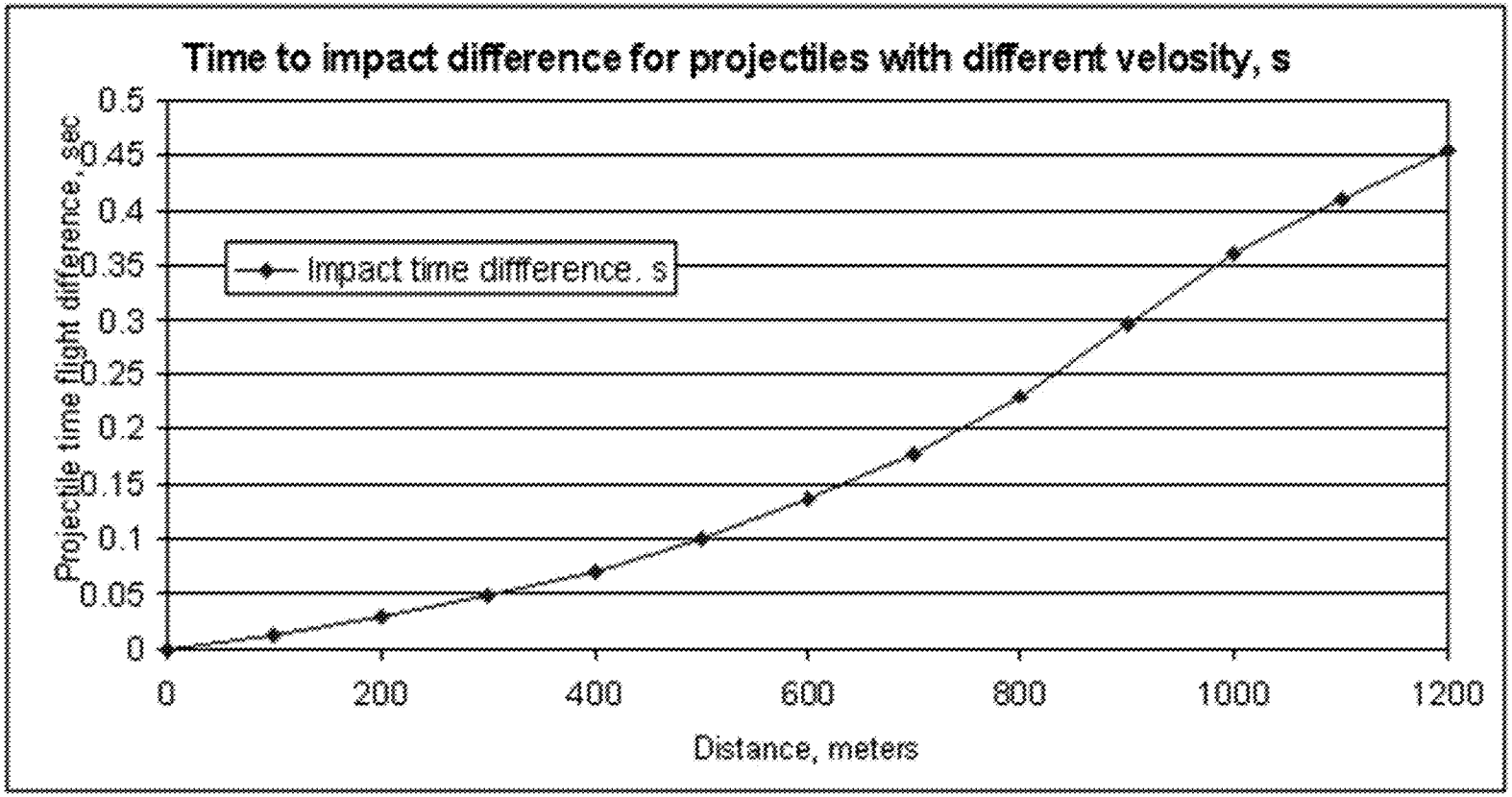
FIG. 7 is a plot of the time to impact difference for projectiles with different velocities fired at the target in the system of FIG. 1.
Figure 8:
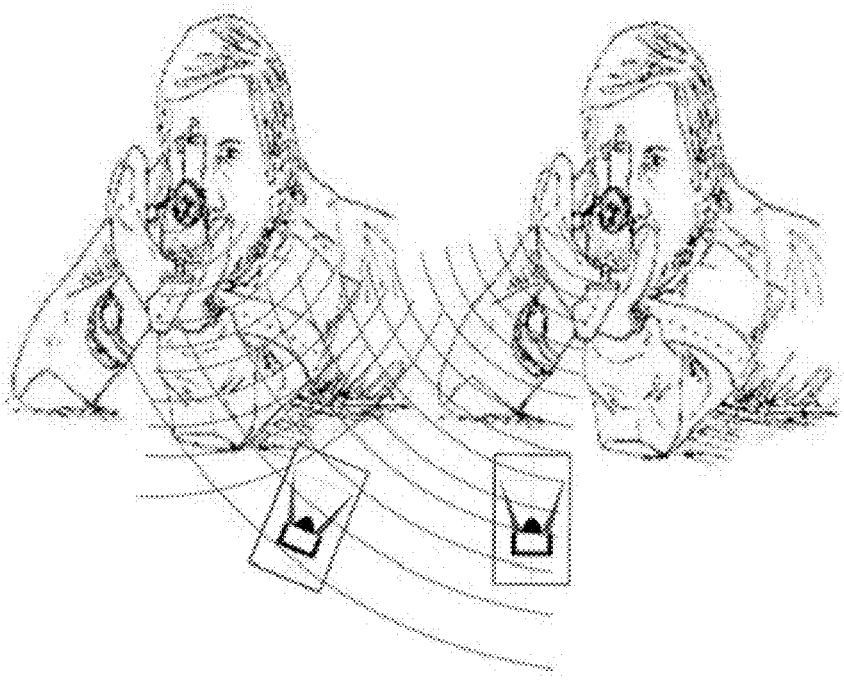
FIGS. 8 & 9 are schematic diagrams showing the possibility of acoustic interference between two shooters.
Figure 9:
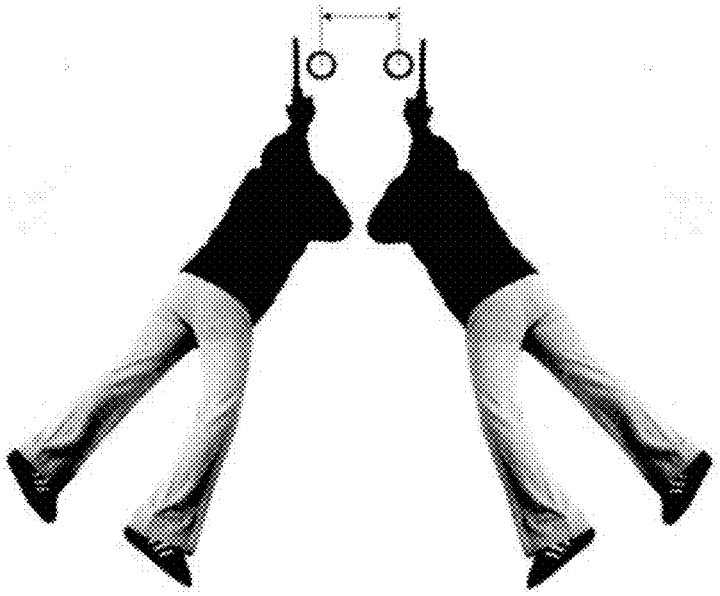

As best shown in FIGS. 7 to 9, the system 1 also most advantageously allows two or more users to shoot simultaneously into the same target 3. The system 1 uses the technique to detect the muzzle blast and then detect impact on the target 3. The system 1 then calculates which shooter shot the first shot and assign the first impact results to this shooter.

However, such simplified systems have a number of problems, which does not allow these systems to be commercially accepted. The present method of the preferred embodiment is based on the assumption that the speed of the projectiles 2 from different shooters is equal. In reality, the projectile speed varies individually for each shooter depending on type of projectile, type of rifle, amount of powder, type of powder. It is possible that shooter A shoots before shooter B but his projectile 2 hits the target 3 later than the projectile of shooter B if his projectile has lower speed. The speed variation between the projectiles 2 of the two shooters on the rifle range may be well above 200 or 300 ft/sec if the shots have projectile speeds of between 2800 and 3100 feet/sec which is typical. If the two shooters fired simultaneously with the projectile speed difference indicated above, their projectile hits the target 3 at 900 meters with the time difference of 0.45 sec (see FIG. 7, which shows projectile time to impact difference vs. distance. Sierra: Palma [2155] (Litz, 0.308, 155gr fired at 2800 ft/sec, and Sierra: HPBT Palma MatchKing, 0.308, 155gr fired at 3100 ft/sec).

As the speed of projectile 2 is uncertain within the range, the time of impact is uncertain. The graph of FIG. 7 shows the time of uncertainty when the system 1 would be unable to detect the projectile 2 of which shooter hits the target 3. This is the compromise between losing the shot or report of a collision where no collision actually occurs. Preferably a conservative approach is taken where the collision will be reported and shooter would have an extra shot rather than system 1 reporting a "miss" or incorrect value. As the system 1 has a deaf time (as above, and most preferably approximately 30 ms) this time also should be added to the collision time margin. For a range 900 meters this time should be 0.3 seconds or 0.5 sec taking a conservative approach.

The problem is statistically that if two shooters are each shooting 1 shot per 30 seconds, the probability of a collision is 50% after 20 shots and is 97% after 103 shots. In case of three shooters shooting simultaneously the probability of a collision is 97% after 63 shots fired. In case of 4 shooters shooting simultaneously the probability of a collision is 97% after 51 shots.

System 1 reduces the probability of collision by measuring the shot properties and reduction of collision time accordingly by employing the following methods:

1. Applying the collision protection time according to known shooting distance as per FIG. 7.
2. Measuring the projectile speed at muzzle point and precisely calculating the impact time.
3. Measure the projectile flight time (the time between firing and impact) and if no collision is detected this time is used for collision margin calculation The muzzle blast detectors 20 typically known to the prior art (best seen in FIG. 8, which also shows the possibility of acoustic interference between two shooters if the muzzle detectors are not accurately positioned) are the acoustical microphones located near the shooters' rifles which detect the muzzle blast and informs system 1 about shot events. The acoustical microphones must be directional otherwise they may detect the next shooter's shots (see FIG. 9, which shows the possibility of acoustic interference becoming even more significant if one of the shooters is left-handed). However, even a directional microphone may pick-up a reflection from a roof if shooters are located under cover. However, it is most preferable if the shooter maintains the rifle in the vicinity of the acoustical microphone/muzzle blast detector. If these requirements fail (shown in FIG. 8) the system 1 fails to function correctly and may result in faulty shot detection or even worse to report a miss for perfect shot.

System 1 reduces the probability of collision by measuring the shots property and reduction of collision time accordingly by the following methods:

- Using an accelerometer muzzle blast detector thereby eliminating any possibility of detecting the muzzle blast of another shooter.
- The acoustic sensors, barrel deformation sensor can be used on the barrel.
- The accelerometer can be attached to the any rifle part or even to the shoulder of the shooter.

Further, the use of the accelerometer in the system allows for provision of a significant improvement in accuracy over all known electronic target systems. If each shooter uses ammunition having uniform characteristics, then accelerometer muzzle blast detection only can be employed with pre-set approximations for muzzle velocity or bullet time-of-flight.

The muzzle detector is firmly wired to the shooter terminal (for RF communications with the range CPU 17 and/or target CPU 16. In case of connection to existing monitors system 1 provides:

- Possibility of muzzle detection connection as standard USB HID device, This allows using standard browser with Java script to get en information from the muzzle detector.
- In case of any other device requires communication with Java script running in browser this method (connected as the standard HID device) also can be used for other purposes.

When the shooters' monitor/client terminal is wired to the muzzle detector and they cannot be passed to other shooters for use freely and shooters have to have redundant hardware even if they are not using the multiple shooting capability, system 1 provides the following features:

- The muzzle detection station is separate from the system 1.
- The muzzle detection station is attached to the sensors only and uses relative method to calculate the shot order.
- The muzzle detection station communicates with the system 1 wirelessly.
- The muzzle detection station synchronizing time with the system 1 via wireless network.

Muzzle detection station can be setup for collision time via wireless network.

Muzzle detection station can be upgraded over wireless network.

Figure 10:
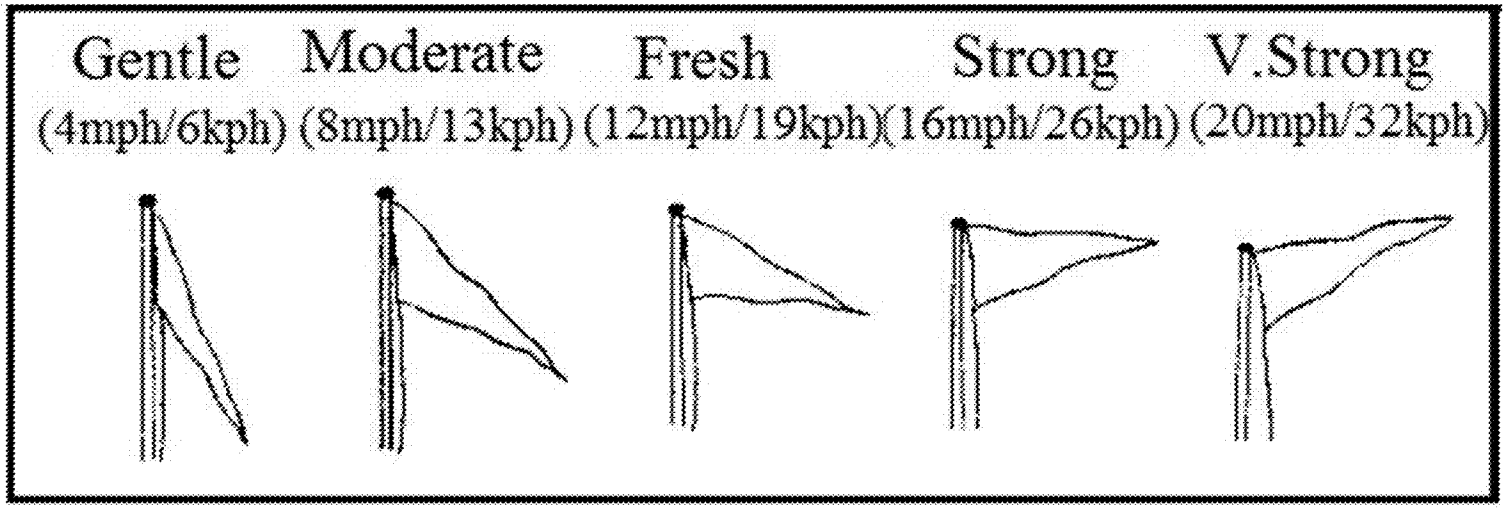
FIG. 10 is a schematic screen shot of a display showing a digital representation of a shooting range anemometer used in the system of FIG. 1.

The system 1 can maintain wireless anemometers or complete weather stations on the range, as desired, which may replace the flags which are currently used as wind indicators. Indicator flags are typically disposed along the sides of a range. Their appearance corresponds to particular wind speeds and is shown in FIG. 10. In the preferred embodiment, the anemometer or anemometers can be placed on the range in desired location and wirelessly transmit the information to the CPU 17. The CPU 17 may distribute these information graphically or numerically to the shooters monitors and to the web server. Such an arrangement removes the need to manual install the flags on course each day and advantageously provides remote spectators with wind speed indication in real-time in the same manner the shooters see.

The system 1 advantageously provides a target 3 that can use five or more pressure sensors 15 to more accurately determine the location of impact of a projectile 2 on the face 4 of a target 3. Additional sensors 15 can be used as desired without significantly increasing the computational load on the target controller 16. The use in the system 1 of all three-sensor combination triplets allows the provision of more accurate real time shot reporting and also allows the reliable use of multiple shooter projectile targets 3. The use of five or more sensors 15 not only provides more accurate determination of projectile position but also allows the provision of redundant information to ignore spurious or inaccurate data and incrementally increase system accuracy and reliability.

In the system 1, the simple wireless set up between target 3, RF wireless link and range computer 17, client terminals/devices and the internet allows the determined information to be easily and quickly sent to the shooters, scorers or a third party directly or via a telephonic network or the internet and no additional load is placed on the target CPU 16. The conventionally known serial cabling arrangement between targets and target computers is also removed improving reliability and flexibility, for example, with respect to faults in the cabling or connection. This removes the significant problem of the prior art which 'daisy-chain' or serially connects targets on a range meaning if one target is disabled, all targets are disabled.

The foregoing describes only one embodiment of the present invention and modifications, obvious to those skilled in the art, can be made thereto without departing from the scope of the present invention.

The term "comprising" (and its grammatical variations) as used herein is used in the inclusive sense of "including" or "having" and not in the exclusive sense of "consisting only of".

While the principles of the invention have been described above in connection with preferred embodiments, it is to be clearly understood that this description is made only by way of example and not as a limitation of the scope of the invention.

The invention claimed is:

1. A projectile target range system including:

at least one target, the or each target having a face arranged to be impacted by a projectile;

the or each target including n pressure wave sensors, wherein n≥5; and a processor arranged to receive data from each of said n sensors; said processor being programmed to operatively:

select different combinations of sensors from said n sensors;

for each combination, analyse the received data to determine a combination output, each combination output being indicative of a potential impact position;

determine whether any determined combination output from any combination varies from the other determined combination outputs from other combinations by at least a predetermined amount, and reject from any further consideration any determined combination output determined to vary by said at least predetermined amount;

determine whether there is a common sensor whose data was used to compute many or all of the rejected combination outputs and, if so, then rejecting all combination outputs including data from the common sensor in determining the impact position; and analysing non-rejected determined combination outputs to determine a mean output; wherein said mean output is taken to indicate the impact position.

2. The system of claim 1, wherein the data from said common sensor is analysed by the processor to determine if a correction can be applied to the common sensor's data output and, if so, the determined correction is applied by the processor to future data received from the common sensor in subsequent impact position determination.

3. The system of claim 1, wherein said step of determining different combinations of sensors from said n sensors comprises determining different combinations of groups of sensors, wherein each group consists of 3 of said n sensors.

4. The system of claim 3, wherein said step of analysing the received data to determine a combination output, for each combination, comprises:

for each combination, deriving a first hyperbolic curve representative of the data received from a pair of sensors selected from the three sensors and deriving a second hyperbolic curve representative of the data received from a different pair of sensors selected from the three sensors; and analysing the first and second hyperbolic curves to determine an intersection point, said intersection point being the combination output.

5. The system of claim 1, wherein the or each target includes a sealed chamber and said n pressure wave sensors are disposed therein.

6. The system of claim 5, wherein the or each target further includes temperature sensors disposed within said sealed chamber and said processor is arranged to receive data from said temperature sensors; wherein said processor is programmed to:

determine if any temperature compensation is required to be applied to any data received from any of said n pressure wave sensors to compensate for temperature variation within said sealed chamber, based upon the data received from said temperature sensors; and apply any determined required temperature compensation.

7. The system of claim 1, wherein said n pressure wave sensors are selected from the group consisting of: ultrasonic transducer, microphone, pressure sensor, magneto-electric sensor, shock sensor, and seismometer.

* * * * *